United States Patent [19]

Branson et al.

[11] 4,194,102

[45] Mar. 18, 1980

[54] CONDITION RESPONSIVE ELECTRICAL SWITCH CONSTRUCTION AND PARTS AND METHODS THEREFOR

[75] Inventors: Charles D. Branson, Greensburg; Harvey J. Shopsky, Latrobe, both of Pa.

[73] Assignee: Robertshaw Controls Company, Richmond, Va.

[21] Appl. No.: 865,594

[22] Filed: Dec. 29, 1977

[51] Int. Cl.[2] ..... H01H 5/18; H01H 37/38; H01H 37/40; H01H 37/60

[52] U.S. Cl. ..... 200/67 D; 29/622; 200/67 PK; 200/83 S; 200/241; 200/246; 200/DIG. 42; 337/318; 337/321

[58] Field of Search ..... 200/293, 153 J, 244, 200/238, 239, 303, 67 PK, 67 R, 67 A, 67 D, 67 DA, 153 K, 246, 250, 283, DIG. 42; 337/309, 311, 312, 319, 323, 327, 330, 307, 321, 115, 116, 117, 118, 119, 120, 121, 122; 29/622

[56] References Cited

U.S. PATENT DOCUMENTS

| | | | |
|---|---|---|---|
| 3,065,323 | 11/1962 | Grimshaw | 337/327 |
| 3,096,419 | 7/1963 | Howell | 337/319 |
| 3,548,131 | 12/1970 | Piber | 200/283 X |
| 3,609,270 | 9/1971 | Jorgensen et al. | 200/67 D |
| 3,656,081 | 4/1972 | John | 200/67 D X |
| 3,735,069 | 5/1973 | Andresen | 200/67 D |
| 3,735,080 | 5/1973 | Andresen | 200/67 D |
| 3,819,896 | 6/1974 | Aidn et al. | 200/283 |
| 4,027,131 | 5/1977 | Aidn et al. | 200/246 |
| 4,045,635 | 8/1977 | Pursnani | 200/283 |

FOREIGN PATENT DOCUMENTS 1266387 4/1968 Fed. Rep. of Germany ..... 200/67 D

OTHER PUBLICATIONS

"Narrow Differential Cold Controls (RC Series)", Robertshaw Controls Co., May, 1975.

*Primary Examiner*—Stephen Marcus
*Attorney, Agent, or Firm*—Candor, Candor & Tassone

[57] ABSTRACT

A condition responsive electrical switch construction having a frame carrying an electrical switch and a condition responsive device having a movable wall for causing movement of a lever that is pivotally carried by the frame and is operatively associated with the switch to operate the same as the lever is moved by the wall to a certain position in cpposition to the force of a range spring also carried by the frame. A cradle-like member has a base operatively associated with the range spring so as to be held thereby against the wall to be moved in unison with the wall and has arms engaging the lever to cause the lever to move in relation to movement of the wall. The switch has a pair of movable contact members disposed on opposite sides of a fixed contact member and each is biased in a direction to tend to place the same in contact with the fixed contact member and each having an offset loop therein. An actuator member controlled by the lever is disposed between the pair of movable contact members and is movable in opposite directions to move the respective movable contact member out of contact with the fixed contact member.

20 Claims, 28 Drawing Figures

CONDITION RESPONSIVE ELECTRICAL SWITCH CONSTRUCTION AND PARTS AND METHODS THEREFOR

BACKGROUND OF THE INVENTION

1. Field of the Invention

This invention relates to an improved condition responsive electrical switch construction as well as to improved parts therefor and/or for other devices and methods of making such parts.

2. Prior Art Statement

It is well known that condition responsive electrical switch constructions have been provided to each act as a "cold control" wherein the same is utilized to control the operation of a refrigerator or the like so that when the temperature in the refrigerator rises to a certain temperature, the control will operate an electrical switch to turn on the refrigerant compressor and continue to operate the refrigerant compressor until the temperature in the refrigerator has fallen a certain differential below the previously described high turn-on temperature whereby the control will cause the switch to turn off the compressor.

For example see the following four items:

(1) U.S. Pat. No. 3,065,323 to Grimshaw (2) U.S. Pat. No. 3,096,419 to Howell (3) U.S. Pat. No. 4,045,635 to Pursnani et al.

(4) Robertshaw Controls Company publication M D 12-C (Rev. 5/75) entitled "Robertshaw R C Series Narrow Differential Cold Controls"

The prior known condition responsive electrical switch construction of item (4) above has a pivotally mounted lever for operating the electrical switch with the lever being pivotally moved by a movable wall of a condition responsive device that is opposed in the expanding direction thereof by a suitable range spring. The range spring includes a pin-like member that passes through a slot in the switch actuating lever so as to have its free end received in a complimentary recess formed in the movable wall of the condition responsive device, the lever being biased against an annular shoulder of the pin member so as to follow movement thereof.

The condition responsive electrical switch construction of items (1) and (2) above each appears to have a cradle-like member to transmit movement of the pin member of the range spring to the switch actuator lever.

The switch housing of item (4) above has two pairs of opposed locating ears received respectively in aligned slots of a housing casing and are held in place by a staking of the casing to deform side edges of the casing slots against adjacent side edges of the ears of the switch housing.

Each of the switch housings of items (1) and (2) above appears to have a single pair of opposed locating ears received respectively in aligned slots of a housing casing and each being wedged between an angled edge of its respective slot and a cooperating flat edge opposed thereto as a cover member is being pivoted into place on the housing casing and thereby camming against the switch housing and causing the switch housing and housing casing to move into the final assembled position thereof.

The electrical switches of items (1), (2) and (4) above each appears to have a single movable contact moved by a kicker of the aforementioned actuating lever relative to a single fixed contact whereas the electrical switch of item (3) above has a single movable contact disposed between a pair of spaced fixed contacts whereby the movable contact is moved between the fixed contacts by the aforementioned actuator lever.

It is also known to have two movable contacts disposed between the two fixed contacts of a similar electrical switch with the two movable contacts respectively being engageable with the fixed contacts and being controlled by the kicker of the aforementioned actuator lever.

It is also known to have a pair of movable contacts disposed on opposite sides of a fixed contact with an actuator member disposed between the movable contacts to respectively move one of the movable contacts away from the fixed contact while the other movable contact remains in contact with the fixed contact.

For example, see the following six United States patents:

(5) U.S. Pat. No. 3,609,270 to Jorgensen et al.

(6) U.S. Pat. No. 3,656,081 to John (7) U.S. Pat. No. 3,735,069 to Andresen (8) U.S. Pat. No. 3,735,080 to Andresen (9) U.S. Pat. No. 3,819,896 to Aidn et al.

(10) U.S. Pat. No. 4,027,131 to Aidn et al.

It is also known to loop a switch blade to provide for a wiping action of the contact thereof with a fixed contact when the looped switch blade is moved by an actuator member in order to break a weld between the movable contact member and the fixed contact member.

For example, see the following two items:

(11) U.S. Pat. No. 3,548,131 to Piber

(12) German Pat. No. 1,266,387 to Lorsbach.

Each of the condition responsive electrical switch constructions of items (1), (2) and (4) above appears to have the selector shaft thereof provided with a cam surface that engages against an abutment of the actuator lever to force the actuator lever against a stop when the selector shaft is rotated to an "off" position thereof.

Each of the condition responsive electrical switch constructions of items (1), (2) and (4) above appears to have the actuator lever thereof be provided with knife-edges which pivot against "vee" edges formed in the casing of the housing means thereof, item (2) appearing to have an additional lever cooperating with the actuating lever to reduce the bearing load on the "vee" edges of the casing.

SUMMARY OF THE INVENTION

It was found according to the teachings of this invention that if misalignment occurred between the range spring arrangement and the pivotally mounted actuator lever during the manufacture of the aforementioned condition responsive electrical switch construction of item (4) above, the range spring pin engages one of the side edges of the slot in the switch actuator lever to thereby provide interference to the free movement therebetween and, thus, an inaccuracy in the operation of the electrical switch so that the control device would turn on the refrigerant compressor at temperatures other than the selected set temperature of the control device.

The cradle-like member of items (1) and (2) above tends to eliminate the adverse effects of misalignment between the switch actuator lever and the range spring arrangement therefor because the cradle-like member transmits movement of the pin member of the range spring to the switch actuator lever.

However, it was found, according to the teachings of this invention, that a high wear area is provided between such cradle-like member and the pin member of the range spring.

Accordingly, it is a feature of this invention to provide a condition responsive electrical switch construction wherein the pin member of the range spring is eliminated.

In particular, one embodiment of this invention provides a condition responsive electrical switch construction having frame means carrying an electrical switch and a condition responsive device having a movable wall for causing movement of a lever that is pivotally carried by the frame means and is operatively associated with the switch to operate the same as the lever is moved by the wall to a certain position in opposition to the force of a range spring also carried by the frame means. A cradle-like member has a base operatively associated with the range spring so as to be held thereby against the wall of the condition responsive device to be moved in unison with the wall and has arm means engaging the lever to cause the lever to move in relation to movement of the wall whereby the range spring does not have a projecting pin member carried thereby to engage the wall of the condition responsive device as in the prior known condition responsive electrical switch constructions.

It was also found according to the teachings of this invention that the electrical switch for such a condition responsive electrical switch construction could be improved because some means must be provided for overshoot movement of the movable contact.

Thus, it was found according to the teachings of this invention that such an electrical switch could be formed with a single fixed contact and a pair of movable contact means.

In particular, one embodiment of this invention provides an electrical switch construction having frame means carrying fixed contact means and movable contact means to be moved relative to the fixed contact means by a kicker-type actuator member, the fixed contact means comprising a single contact member and the movable contact means comprising a pair of movable contact members disposed on opposite sides of the fixed contact member and each being biased in a direction to tend to place the same in contact with the fixed contact member. The actuator member is disposed between the pair of movable contact members and is movable in opposite directions to engage and move the respective movable contact member out of contact with the fixed contact member. Each movable contact member comprises a conductive blade having two legs joined together by a loop at adjacent ends of the legs, one of the legs being substantially straight and having the loop offset therein at the end thereof to cause that leg to tend to elongate between the fixed contact member and the outside edge of the loop should a weld exist between that leg and the fixed contact member when the actuator member is attempting to move that conductive blade out of contact with the fixed contact member. Each conductive blade has the one leg thereof engageable with the actuator member and adapted to make contact with the fixed contact member intermediate the offset loop thereof and where the actuator member is engageable with that one leg.

It was found, according to the teachings of this invention, that as a matter of convenience each of the casings of such condition responsive electrical switch constructions is normally constructed with tabs to be folded over as a fastening means for the cover and power element thereof and thereby creates the need for a ductile casing. However, such casing is normally constructed with "vee" pivot seats for one or more pivoting levers. While it is common practice to harden the knife-edges of the actuator lever, to minimize wear thereon, little can be done to protect the "vee" casing seats because the casing must be kept soft for the aforementioned ease of assembly purposes.

Thus, an additional lever in item (2) above was provided to reduce bearing load, particularly, for a high temperature differential control.

However, it is a feature of this invention to provide hardened "vee" seats for the hardened knife-edges of the actuator lever.

In particular, one embodiment of this invention provides a one-piece hardened metallic insert carried by the frame means of the condition responsive electrical switch construction and having a plurality of fulcrum surfaces against which the actuator lever pivots.

It was also a feature of this invention to provide improved assembly alignment between the electrical switch housing and the remaining casing of the housing means for any of the aforementioned condition responsive electrical switch constructions or other constructions, as desired.

In particular, one embodiment of this invention provides a housing construction for an electrical switch construction or the like having one housing member partially telescoped inside another housing member to have a pair of opposed ear means of the one housing member respectively project through a pair of opposed slot means in the other housing member together with a cover member secured to one of the housing members to hold the same in their assembled and telescoped relation, each of the slot means of the other housing member being defined in part by a pair of opposed surface means of the other housing member one of which comprises a biasing section. Each ear has opposed edge means respectively press-fitted between the surface means of its respective slot means whereby the biasing sections hold one of the edge means of the ears against the other surface means of the slot means.

It was also found according to the teachings of this invention that when the selector means of any of the aforementioned condition responsive electrical switch constructions was turned to the "off" condition thereof, there was a tendency to cause the actuator lever to move out of its pivoted position should there be any over travel between the engaged abutment means of the actuator lever and the cam surface of the selector means.

Accordingly, it is a feature of this invention to provide an improved selector arrangement for such a condition responsive electrical switch construction for holding the actuator lever in its "off" position.

In particular, one embodiment of this invention provides a condition responsive electrical switch construction having a movable selector means that is operatively associated with an abutment means of an actuator lever to move the lever against a stop when the selector means is moved to an "off" position thereof, the selector means including a biasing means disposed between a cam surface of the selector means and the abutment means to transmit motion of the cam surface to the abutment means and to take up over travel movement of the cam surface after the lever has been moved against its "off" stop.

Accordingly, it is an object of this invention to provide an improved condition responsive electrical switch construction having one or more of the novel features of this invention as set forth above or hereinafter shown or described.

Another object of this invention is to provide an improved part for such an electrical switch construction or the like, the improved part of this invention having one or more of the novel features of this invention as set forth above or hereinafter shown or described.

Another object of this invention is to provide an improved method of making such an improved part of this invention, the method of this invention having one or more of the novel features set forth above or hereinafter shown or described.

Other objects, uses and advantages of this invention are apparent from a reading of this description which proceeds with reference to the accompanying drawings forming a part thereof and wherein.

Figure 1:
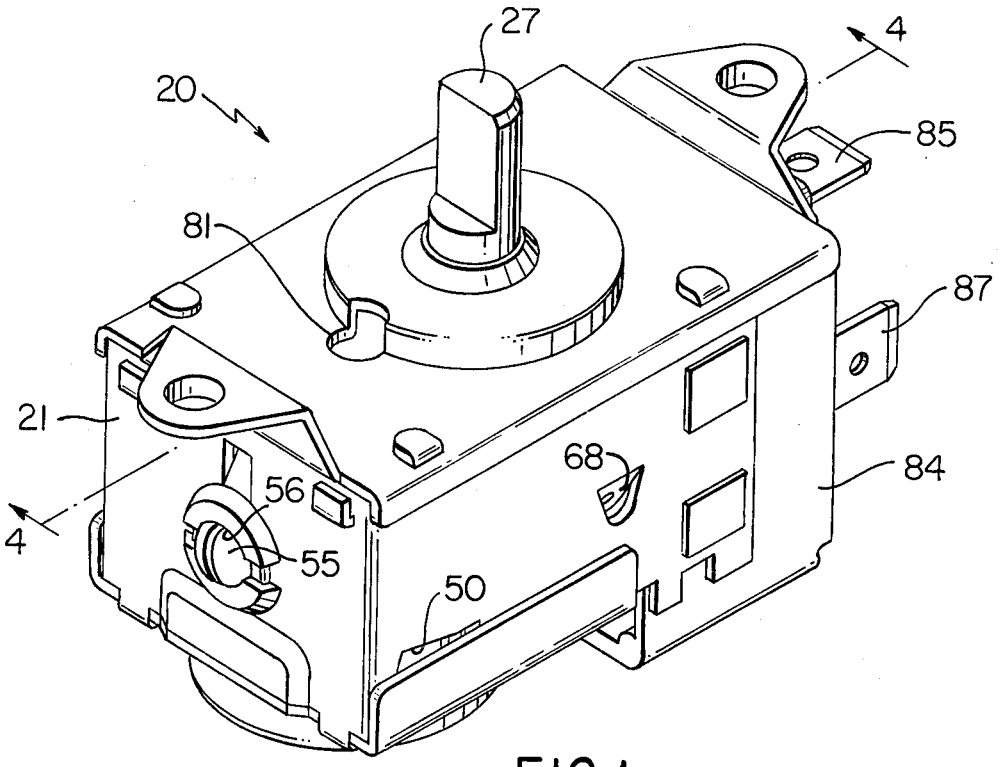
FIG. 1 is a top perspective view of the improved condition responsive electrical switch construction of this invention.

While the various features of this invention are hereinafter illustrated and described as being particularly adapted to provide a condition responsive electrical switch construction for controlling the operation of a refrigerator or the like in the manner of a "cold control," it is to be understood that the various features of this invention can be utilized singly or in any combination thereof to provide a condition responsive electrical switch construction for other devices as desired.

Further, while the particular electrical switch construction of this invention is hereinafter illustrated and described as being particularly adapted to provide the electrical switch for the condition responsive electrical switch construction of this invention, it is to be understood that the electrical switch construction of this invention can be utilized for other purposes as desired.

Therefore, this invention is not to be limited to only the embodiments illustrated in the drawings, because the drawings are merely utilized to illustrate on of the wide variety of uses of this invention.

Figure 4:
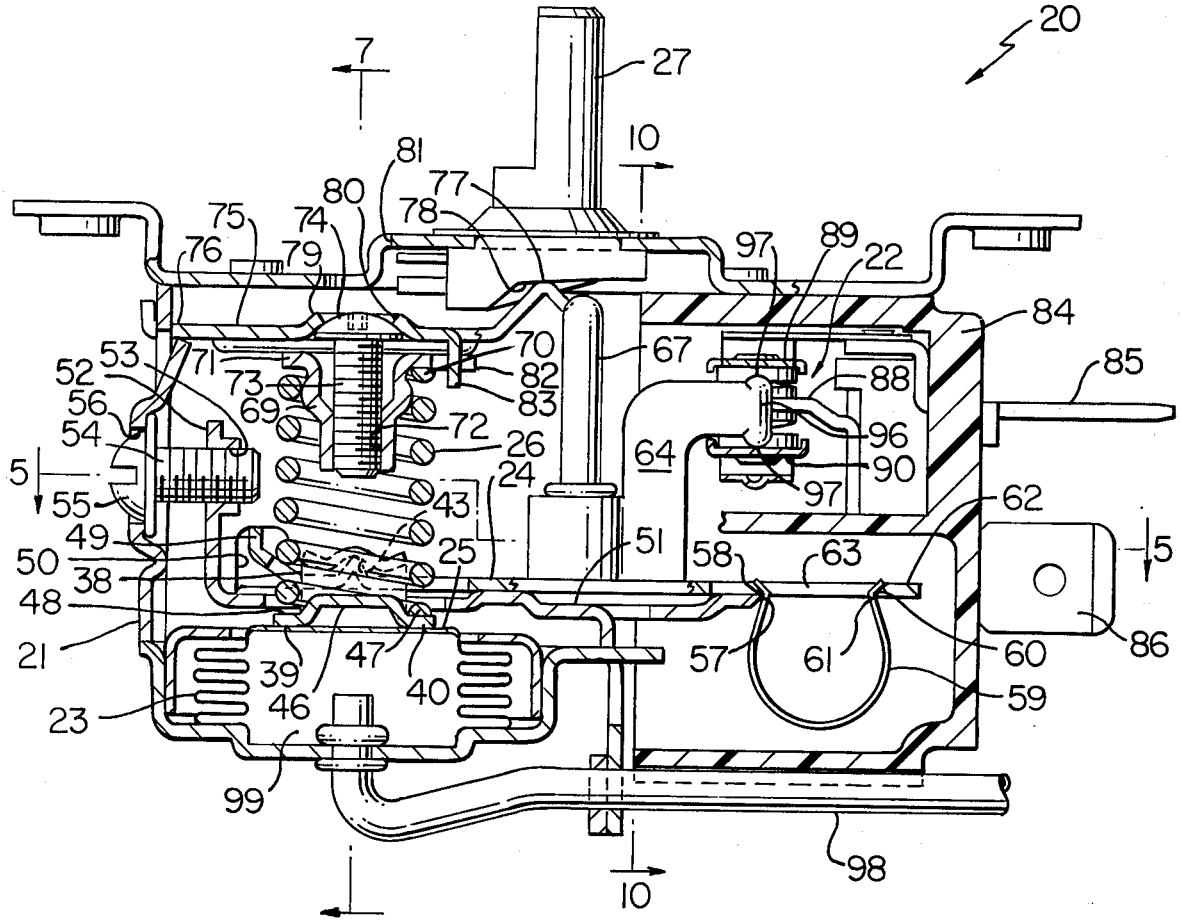
FIG. 4 is an enlarged cross-sectional view taken on line 4—4 of FIG. 1 and illustrates the improved condition responsive electrical switch construction of this invention.

Referring now to FIGS. 1 and 4, the improved condition responsive electrical switch construction of this invention is generally indicated by the reference numeral 20 and comprises a frame means 21 carrying an electrical switch that is generally indicated by the reference numeral 22 and a condition responsive device 23 that operates the electrical switch 22 through the action of a lever 24 that is pivotally carried by the frame means 21 and follows the movement of a movable wall 25 of the condition responsive device 23 that acts in opposition to the force of a settable range spring 26 whereby the switch 22 is operated to one condition thereof when the condition responsive device 23 senses a certain temperature set by the control shaft 27 of the control device 20 in a manner hereinafter described.

Such action of the condition responsive electrical switch construction 20 is a normal function of various condition responsive electrical switch constructions that have been provided in the past for controlling the operation of refrigerators or the like wherein the condition responsive device of each unit will through the lever arrangement cause the electrical switch to turn on the refrigerant compressor when the temperature of the refrigerator reaches a certain high temperature and will thereafter cause the switch to turn off the refrigerant compressor when the temperature in the refrigerator has fallen a certain differential below the previously described high turn-on temperature setting thereof.

However, as previously described, it was found that in at least one type of prior known condition responsive electrical switch construction that the range spring therefor was provided with a pin member that nested within a recess of the movable wall of the condition responsive device and provided an interference fit with the lever arrangement should normal manufacturing tolerances provide a misalignment between the range spring arrangement and the lever arrangement.

Figure 2:
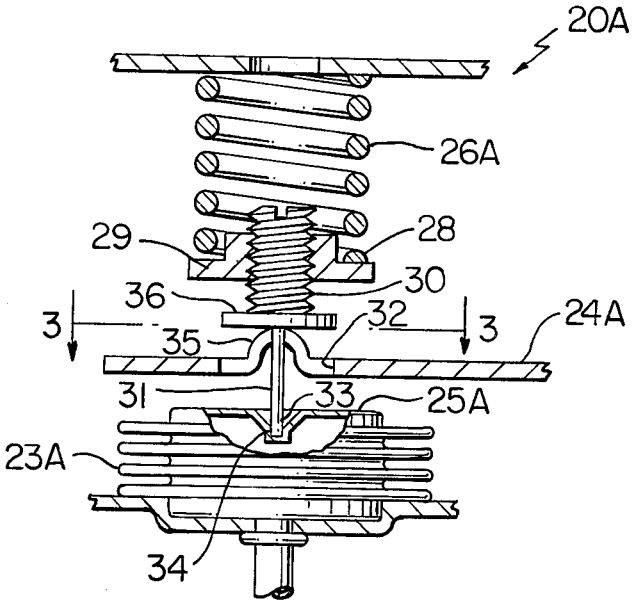
FIG. 2 PRIOR ART
FIG. 2 is a fragmentary cross-sectional view illustrating a prior art condition responsive electrical switch construction.
Figure 3:
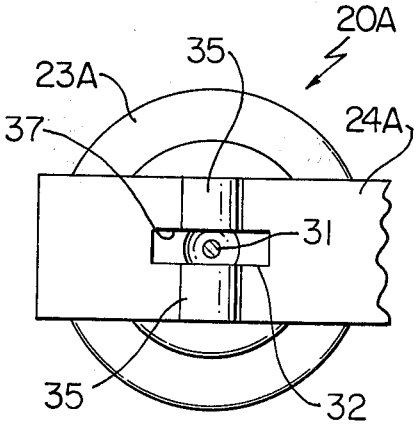
FIG. 3 PRIOR ART
FIG. 3 is a fragmentary cross-sectional view taken on line 3—3 of FIG. 2.

For example, such prior known condition responsive electrical switch construction is generally indicated by the reference numeral 20A in FIGS. 2 and 3 and parts thereof similar to the condition responsive electrical switch construction 20 of this invention as previously generally described are indicated by like reference numerals followed by the reference letter "A."

As illustrated in FIGS. 2 and 3, the prior known condition responsive electrical switch construction 20A includes the range spring 26A, switch actuator lever 24A and condition responsive device 23A. However, the range spring 26A has its lower end 28 bearing against a spring retainer 29 that threadedly carries a pin member 30 having a projecting pin 31 that passes through a relatively narrow slot 32 in the lever 24A and has its lower end 33 received in a complimentary recess 34 formed in the movable wall 25A of the condition responsive device 23A. The lever 24A is provided with rounded embossments 35 on opposite sides of the slot 32 thereof that engage against an outwardly directed disc-like abutment 36 of the pin member 30 to be held thereagainst by another spring arrangement (not shown) so as to follow the up and down movement of the movable wall 25A of the condition responsive device 23A.

However, it was found according to the teachings of this invention that should a misalignment occur between the pin member 30 and the lever 24A during the assembly of the control device 20A, such as would occur when the recess 34 of the condition responsive device 23A is out of alignment with the slot 32 in the lever 24A, the projecting pin 31 of the pin member 30 would engage against one of the side edges 37 of the lever 24A and thereby provide a friction interference fit with the lever 24A to retard free movement of the lever 24A relative to the pin member 30. In this manner, the interference fit between the lever 24A and the pin 31 causes the switch construction 20A to operate the switch thereof at a different temperature than the desired temperature setting of the control device 20A. Thus, it might be found that if the prior known condition responsive electrical switch construction 20A has its range spring 26A set to turn on the refrigerant compressor when the temperature in the refrigerator reached 35° F., the same might not turn on the refrigerant compressor until the temperature reached approximately 40° F. because of the interfence caused between the upward movement of the lever 24A and the pin 31 for the reasons previously set forth.

Therefore, as previously set forth, it is a feature of this invention to provide the condition responsive electrical switch construction 20 of this invention without a pin arrangement for the range spring 26 thereof so that the aforementioned misalignment problem for the lever 24 will be eliminated.

In particular, the improved condition responsive electrical switch construction 20 of this invention includes a cradle-like member 38 having a base 39 provided with a flat annular bottom surface 40 that engages against the flat movable wall 25 of the condition responsive device 23 without any restricting and nesting recess being provided between the cradle member 38 and the wall 25 of the condition responsive device 23 whereby any misalignment between the cradle-like member 38 and the condition responsive device 23 can readily take place as the base 39 of the cradle-like member 38 is relatively large and can be off-center with the wall 25 while still following the movement thereof.

Figure 7:
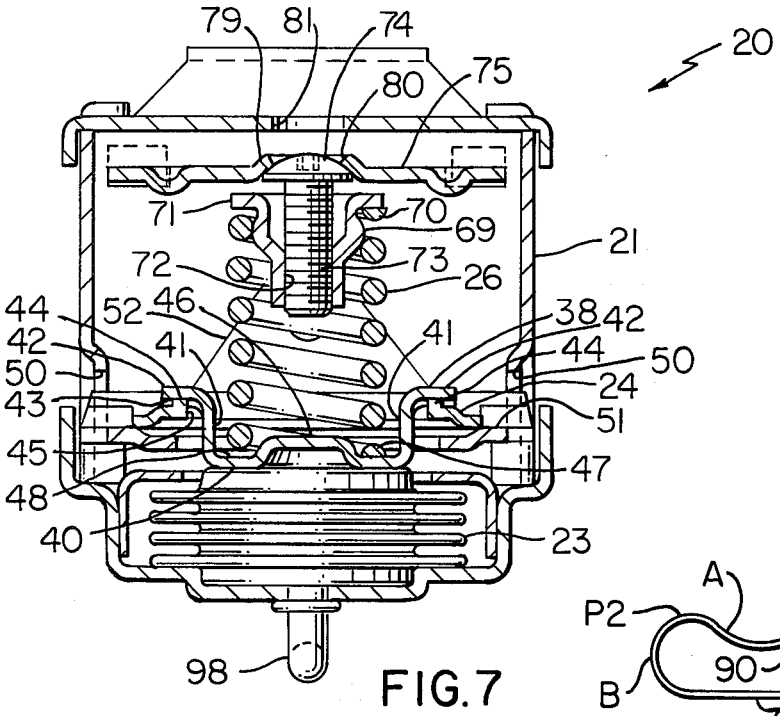
FIG. 7 is a cross-sectional view taken on lines 7—7 of FIG. 4.

The cradle-like member 38 has a pair of upwardly directed arms 41 each provided with an outwardly turned end 42 provided with a rounded embossment 43 to receive a knife edge 44 formed on the lever 24 adjacent a relatively large cutout or opening 45 passing therethrough that permits the cradle-like member 38 to pass therethrough in the manner illustrated in FIG. 7 to fully seat against the movable wall 25 of the condition responsive device 23, such large opening 45 readily permitting misalignment between the cradle-like member 38 and the lever 24 to take place because the embossments 43 on the arms 41 are relatively long and will still receive the knife edge 44 of the misaligned lever 24 therein.

If desired, the base 39 of the cradle-like member 38 can be provided with a raised central portion 46 around which the lower end 47 of the coiled compression range spring 26 can nest as illustrated in FIGS. 4 and 7 to engage against an annular flat surface 48 of the base 39 of the cradle-like member 38 so that the force of the range spring 26 will hold the base 39 of the cradle-like member 38 against the movable wall 25 of the condition responsive device 23 for a purpose hereinafter described.

Figure 5:
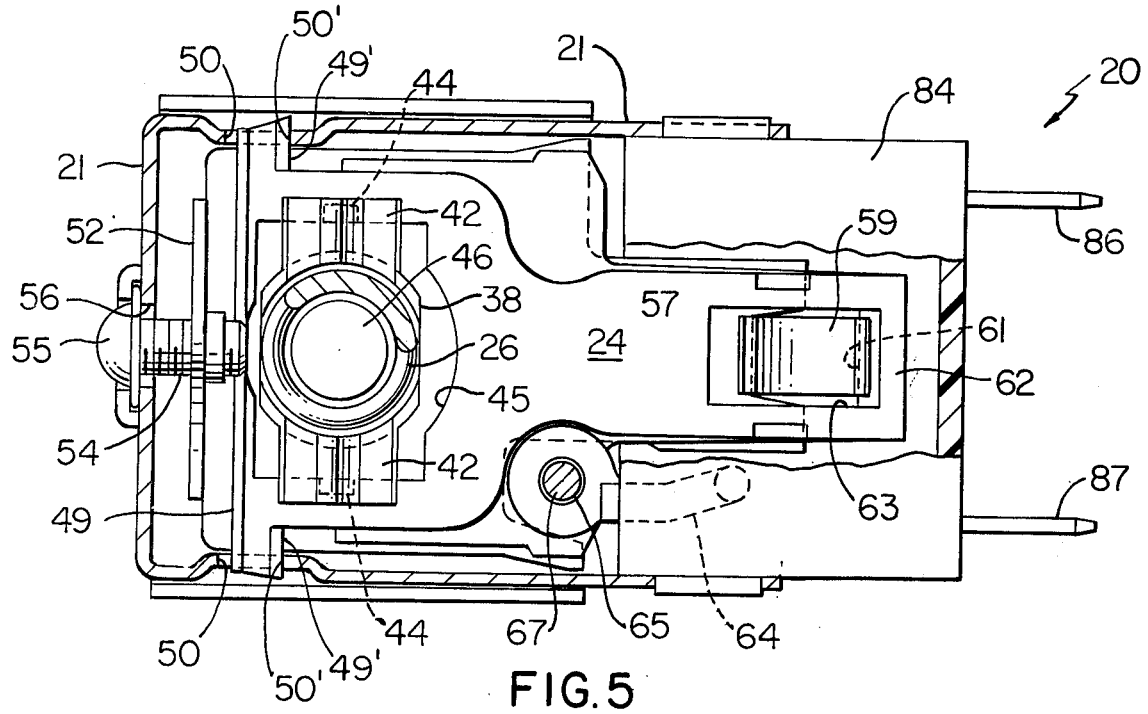
FIG. 5 is a cross-sectional view taken on line 5—5 of FIG. 4.
Figure 6:
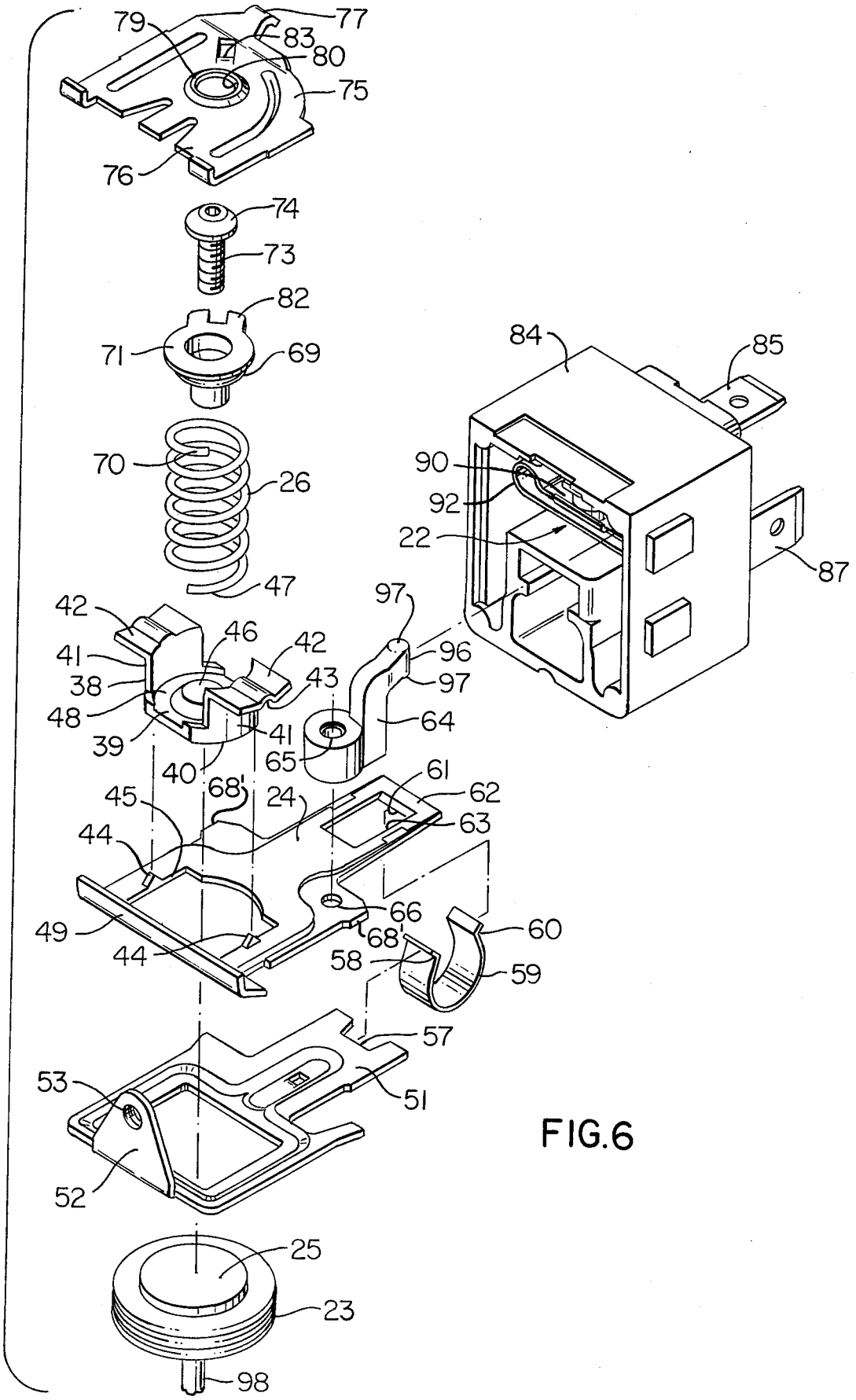
FIG. 6 is an exploded perspective view of various parts of the condition responsive electrical switch construction of FIG. 4.

The lever 24 has an end L-shaped flange 49 that is pivotally mounted in suitable side openings 50 in the frame means 21 to pivotally mount the lever 24 to the frame means 21 to the left of the cradle-like member 38 in FIG. 4, the flange 49 having knife edges 49' that pivot against the edges 50' of the side openings 50 as best illustrated in FIG. 5.

An adjustable spring retaining plate 51 is carried by the frame means 21 and has an upturned end flange 52 provided with a threaded opening 53 receiving a threaded adjusting member 54 that has a slotted head 55 engaging against the frame means 21 and partially projecting out of an opening 56 in the frame means 21 so that the threaded member 54, when turned by a tool external to the frame means 21, can adjust the plate 51 relative to the frame means for setting the switch differential for the control device 20 for a purpose hereinafter described.

The plate 51 has a knife edge 57 received in a notch 58 of a rolling, C-shaped spring 59 while another notch 60 of the C-shaped rolling spring 59 engages against a knife edge 61 at the right-hand end 62 of the lever 24 as illustrated in FIG. 4, the knife edge 61 being defined by an opening 63 passing through the end 62 of the lever 24 as illustrated.

In this manner not only does the compressed force of the C-shaped spring 59 hold the knife edges 49' of the lever 24 against the frame edges 50' and the head 55 of adjusting member 54 for the plate 51 against the frame means 21, but also the C-shaped spring 59 causes the lever 24 to snap upwardly or downwardly as the case may be as the movable wall 25 of the condition responsive device 23 pivots the lever 24 upwardly or downwardly as will be apparent hereinafter, the rolling spring 59 also tending to maintain the knife edges 44 of the lever 24 in engagement with the notches 43 of the arm ends 42 of the cradle-like member 38 through the natural bias of the rolling spring 59.

The lever 24 carries a switch actuator 64 of the "kicker-type" for operating the electrical switch 22 in a manner hereinafter described, the switch actuator 64 being fastened to the plate 24 by suitable fastening means 67 passing through aligned openings 65 and 66 in the actuator 64 and the plate 24.

To limit upward movement of the lever 24, adjustable and opposed triangular lanced tabs 68 are formed in the frame means 21 and overlap projections 68' on the lever 24 whereas downward movement of the lever 24 is limited by the plate 51 as the lever 24 will engage against the plate 51 as illustrated in FIG. 4 to limit downward movement thereof.

The range spring 26 has a tubular member 69 telescoped into the upper end 70 thereof with the tubular member 69 having an annular flange 71 at the upper end thereof that bears against the end 70 of the range spring 26 as illustrated. The tubular member 69 is internally threaded at 72 and threadedly receives a threaded adjusted member 73 that has an enlarged head 74 that is slotted and projects out of the upper end 71 of the tubular member 69.

A cam operated lever 75 is pivotally mounted to the frame means 21 at the end 76 thereof while the other end 77 of the lever 75 engages against a cam surface 78 of the control shaft 27, an intermediate part 79 of the lever 75 bearing against the enlarged head 74 of the threaded adjusting member 73. The intermediate part 79 of the lever 75 has an opening 80 passing therethrough and exposing part of the enlarged head 74 of the threaded adjusting member 73 to permit the same to be rotated relative to the tubular member 69 for adjusting purposes as a screwdriver or the like can be inserted through an opening 81 in the frame means 21 as illustrated in FIG. 1.

The annular flange 71 of the tubular member 69 has a bifurcated part 82 which receives a downwardly directed tongue 83 of the lever 75 to thereby prevent rotation of the threaded tubular member 69 during threading adjustment of the adjusting member 73 relative thereto.

In this manner, the force of the range spring 26 bearing downwardly on the movable wall 25 of the condition responsive device 23 through the base 39 of the cradle-like member 38 can be adjusted by turning the control shaft 27 as the control shaft 27 will position the cam surface 78 acting downwardly on the end 77 of the lever 75 and, thus, position the upper end 70 of the compression spring 26 relative to the frame means 21 which, of course, sets the amount of force that the compression spring 26 is imposing downwardly on the movable wall 25 on the condition responsive device 23.

In this manner, the control shaft 27 adjusts the range spring 26 to adjust the control device 20 so that the same will snap the lever 27 upwardly to operate the switch 22 when the condition responsive device 23 is sensing a certain high turn-on temperature and will cause the lever 24 to snap downwardly and operate the switch 22 when the condition responsive device 23 is sensing a certain temperature below the previously described high turn-on temperature that will be apparent hereinafter.

The electrical switch 22 of this invention includes a separate housing or frame means 84 that is adapted to be disposed in the frame means 21 to form part of the same as illustrated, the housing 84 carrying three terminals 85, 86 and 87 that project outwardly from the same and inwardly into the same for external lead attachment purposes.

A relatively rigid and stationary contact member 88 is disposed in the housing means 84 and is fastened to the terminal 86 to be electrically interconnected thereto.

Figure 10:
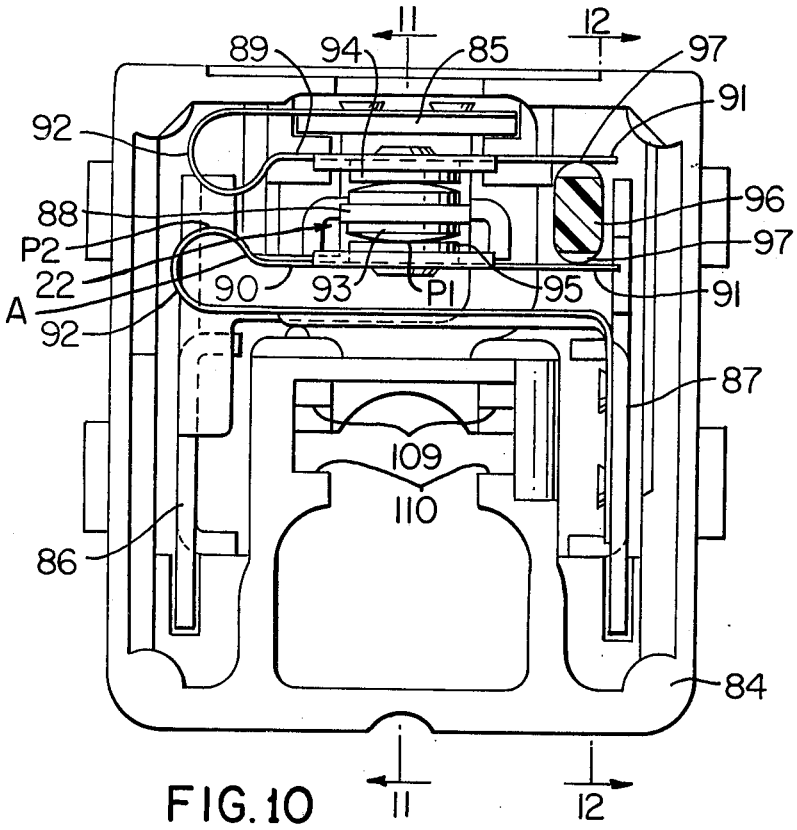
FIG. 10 is an enlarged cross-sectional view taken on line 10—10 of FIG. 4 with the lever structure thereof removed to best illustrate the electrical switch construction of the invention.
Figure 11:
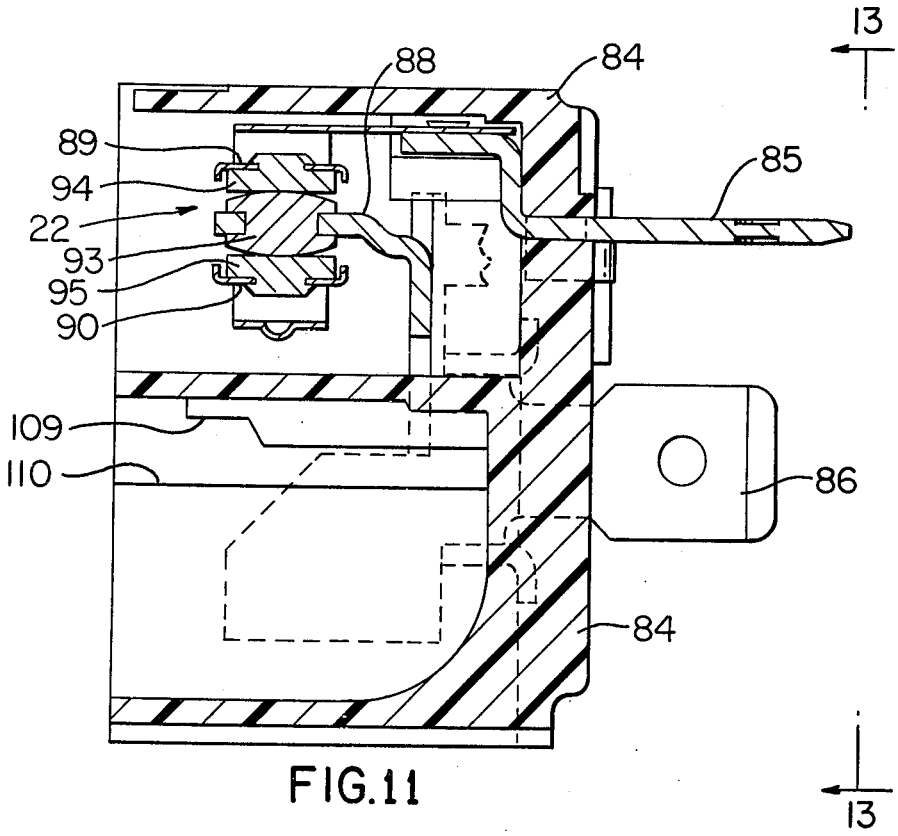
FIG. 11 is a cross-sectional view taken on line 11—11 of FIG. 10.

A pair of movable contact members 89 and 90 are also disposed in the housing means 84 and are respectively secured to the terminals 85 and 87 to be electrically interconnected thereto, each movable contact member 89 and 90 comprising a relatively flexible conductive member looped on itself in substantially a U-shape so that a free end 91 of each movable contact 89 and 90 extends transverse to the fixed contact member 88 and to one side thereof that is opposite to the side where the loops 92 of the contact members 89 and 90 are located as fully illustrated in FIG. 10. If desired, the rigid or fixed contact member 88 can carry a contact 93 as illustrated in FIG. 11 and the movable contact members 89 and 90 can carry contacts 94 and 95 as illustrated in FIG. 11 to respectively engage against the contact 93 of the contact member 88 for a purpose hereinafter described.

The kicker-type actuator 64 has an end 96 provided with opposed rounded abutments 97 which are adapted to be disposed between the free ends 91 of the movable contact members 89 and 90 to the side of the fixed contact 88 as illustrated in FIG. 10.

In this manner, when the actuator 64 is moved upwardly by the lever 24 in a manner hereinafter described, the actuator 64 moves the upper contact member 89 away from the fixed contact member 88 while permitting the natural bias of the lower contact member 90 to move into contact with the fixed contact member 88. Conversely, when the actuator 64 is moved downwardly by the lever 24, in the manner hereinafter described, the actuator 64 moves the lower movable contact member 90 out of electrical contact with the fixed contact member 88 while permitting the natural bias of the upper movable contact member 89 to move the same into electrical contact with the fixed contact 88.

The abutment 97 of the actuator member 64 can be constructed in any desired manner so that the size of the same, when in an intermediate position as illustrated in FIG. 10, will permit both movable contacts 89 and 90 to be disposed in electrical contact with the fixed contact 88 so that the abutments 97 of the actuator 64 will always cause one or the other of the movable contact members 89 and 90 to be in contact with the fixed contact 88, or the abutments 97 can be so constructed and arranged that the same will never permit both of the movable contacts 89 and 90 to be simultaniously in contact with the fixed contact 88 so that before one movable contact can be placed in contact with the fixed contact, the other movable contact must be first moved out of contact with the fixed contact.

Thus, by so sizing the abutments 97 on the switch actuator 64, the switch 22 can be a single pole, double throw switch, a reverse acting switch or a direct acting switch.

In any event, it can be seen that the actuator 64 will operate the switch 22 through the action of the abutments 97 on the movable contacts 89 and 90 as the actuator 64 is moved upwardly and downwardly by the lever 24.

Accordingly, it can be seen that the electrical switch construction 22 of this invention can be made by the method of this invention in a unique manner as previously described to be operated by the lever 24 of the condition responsive switch construction 20 of this invention that operates in a manner now to be described.

Assume that the condition responsive electrical switch construction 20 of this invention is being utilized in a refrigerator to control the temperature thereof so that when the lever 24 is moved upwardly a certain amount, the switch 22 is operated by the actuator 64 to have the upper movable contact member 89 moved away from the fixed contact 88 and have the lower movable contact 90 be permitted to move into contact with the fixed contact 88 whereby such condition of the switch construction 22 will cause the refrigerant compressor of the refrigerator to be in an "on" condition and thereby tend to reduce the temperature in the refrigerator, the bellows-type condition responsive device 23 sensing the temperature in the refrigerator by means of a capillary tube 98 interconnecting a temperature sensing bulb (not shown) to the interior 99 of the condition responsive device 23 in a manner well known in the art.

Also, assume that when the lever 24 is in its down position as illustrated in FIG. 4, the actuator 64 operates the switch construction 22 so that the upper movable contact 89 is in contact with the fixed contact 88 and the lower movable contact 90 is held out of contact with the fixed contact 88 so that the refrigerant compressor is in an "off" condition thereof.

Thus, the control shaft 27 of the control device 20 is turned to the desired temperature setting that the control device 20 is to turn on the refrigerant compressor should the temperature in the refrigerator reach such temperature, such as 35° F. Such rotation of the shaft 27 positions the cam surface 78 that acts downwardly on the end 77 of the lever 75 to place the upper end 70 of the range spring 26 to the desired position relative to the frame means 21 so that the force of the range spring 26 opposing the upward movement of the wall 25 of the condition responsive device 23 is set for that particular temperature. Also, the adjusting member 55 has been factory, or is field adjusted to the desired position so that the switch construction 22 will turn off the refrigerant compressor when the temperature of the refrigerator has fallen below the temperature that turned on the refrigerant compressor a certain amount, such as 5° F., so that the refrigerant compressor will be turned off when the temperature in the refrigerator reaches approximately 30° F. in this example.

Therefore, as long as the temperature in the refrigerator stays below the approximately 35° F. setting of the control device 20, the force of the range spring 26 is sufficient to hold the movable wall 25 of the condition responsive device 23 in such a position that the lever 24 is in its down position whereby the upper movable contact 89 of the switch construction 22 is disposed against the fixed contact 88 and the movable contact 90 is held away from the fixed contact 88 by the kicker-type actuator 64 and, thus, the refrigerant compressor is in its "off" condition.

However, when the temperature in the refrigerator reaches 35° F., the fluid in the chamber 99 of the condition responsive device 23 has so expanded that the same moves the movable wall 25 thereof upwardly in opposition to the force of the compression spring 26 to such a position that the lever 24 is pivoted sufficiently in a counter clockwise direction in FIG. 4 so that the rolling spring 59 will snap the same further upwardly in opposition to the force of the compression spring 26 and kick the upper movable contact 89 out of contact with the fixed contact 88, and thereby rupture any weld therebetween, and permit the lower movable contact 90 to be placed into contact with the fixed contact 88 and thereby cause the refrigerant compressor to be turned on to begin to lower the temperature in the refrigerator.

As the temperature in the refrigerator begins to decrease below 35° F. and eventually reaches the 30° F. temperature of this example, the fluid in the chamber 99 of the condition responsive device 23 has contracted sufficiently that the force of the compression spring 26 can now pivot the lever 24 in a clockwise direction in FIG. 4 so that when the lever 24 reaches a certain position, the rapid decay in the effective force of the rolling spring 59 will permit the lever 24 to snap further downwardly and thereby cause the kicker-type actuator 64 to kick the movable contact 90 out of contact with the fixed contact 88, and thereby breaking any weld therebetween, and permit the upper movable contact 89 to move back into contact with the fixed contact 88 so that the refrigerant compressor for the refrigerator is now turned to an "off" condition thereof.

In this manner, the control device 20 will cycle the refrigerant compressor on and off to tend to maintain the temperature in the refrigerator at the selected temperature setting of the control shaft 27 as in the prior known "cold controls" except that in the control device 20 of this invention, any misalignment between the lever 24 and the range spring arrangement 26 will not impede the movement of the lever 24 so that the accuracy of the operation of the control device 20 of this invention will be maintained at all times.

Further, because the lever 24 of the control device 20 of this invention does not have any interference in its up and down movement thereof, the actuator 64 of the switch construction 22 of this invention will be provided with the maximum mechanism to break contact welds and prevent frying of the contacts thereof.

Figure 8:
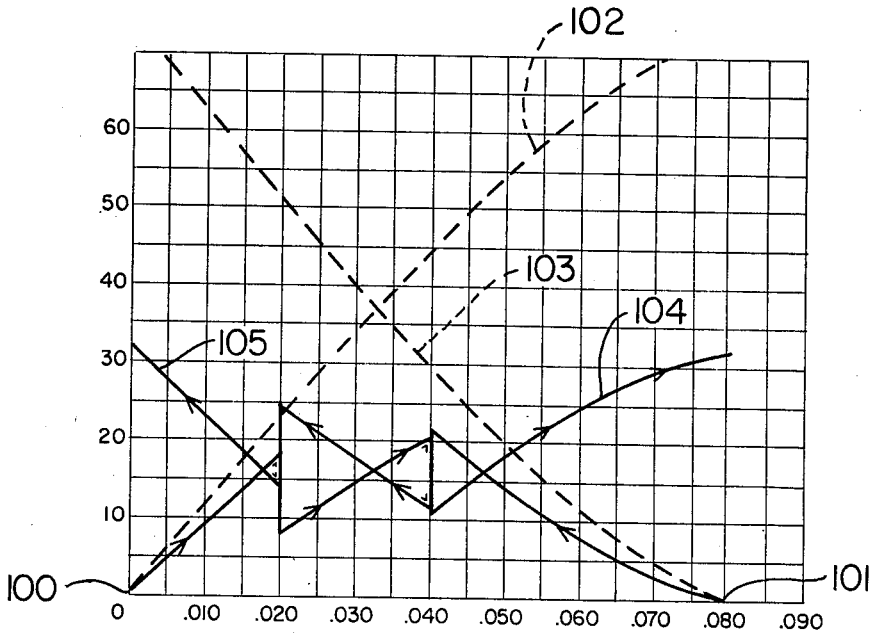
FIG. 8 is a graph representing the force performance of the switch actuator lever of the condition responsive electrical switch construction of FIG. 4.

For example, reference is now made to FIG. 8 wherein a graph is provided to represent on the X axis thereof the movement of the lever 24 in inches and the force developed by such lever 24 in grams on the Y axis thereof, as measured at the kicker abutments 97 for a specific control differential. The graph of FIG. 8 represents at the point 100 thereon the force of the lever 24 when the lever 24 is in its fully down position of FIG. 4 and the condition responsive device 23 is sensing a temperature to just cause lever 24 to initiate its snap from the down position of the control device 20 and the point 101 on the graph of FIG. 8 represents the force being developed by the lever 24 when the lever 24 is in its up condition against its stops 68 and is at a point to initiate its snap from the up position to the down position.

Thus, should the lever 24 be free to move without having the electrical switch construction 22 be operated thereby, the force developed by the lever 24 from the low stop point 100 thereof is represented by the dash line 102 as the lever 24 is being pivoted in a counterclockwise direction in FIG. 4 by an expanding condition responsive device 23 and the force of the lever 24 from the high pressure stop point 101 thereof is represented by the dash line 103 as the lever is being pivoted in a clockwise direction in FIG. 4 by the range spring 26 through a collapsing condition responsive device 23.

However, when the kicker-type actuator 64 is operating on the switch construction 22, the force of the lever 24 is represented by the two heavy lines 104 and 105 on the graph of FIG. 8. The line 104 indicates the upward movement and surplus force of the lever 24 above that required to move the upper movable contact 89 out of contact with the fixed contact 88 and the line 105 representing the surplus force of the lever 24 above that being utilized to move the lower movable contact 90 out of contact with the fixed contact 88 whereby it can be seen that a force is provided by the lever 24 to break contact welds. The curves 104 and 105 display the force unbalance at the kicker abutments 97 as the lever 24 travels between its stops.

In addition, the looped blade 89 or 90 of the switch construction 22 of this invention provides a beneficial weld breaking force when contact welds occur.

Figure 14:
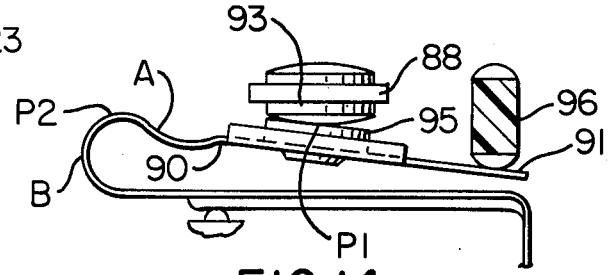
FIG. 14 is a fragmentary view similar to FIG. 10 and illustrates the contact weld breaking action of the switch construction of this invention.

In particular, consider the kicker 96 moving downwardly in FIG. 10 to break contacts 93 and 95 which are welded together at the point P1. The strength of such weld can be such that it cannot be broken by the straight tensile force that can be imposed upon it by the kicker force alone. However, when the kicker 96 engages the contact leaf 91, the blade 90 tends to bend at point A thus causing a pivoting action at the weld P1 as illustrated in FIG. 14. This pivoting action imposes three different modes of torture on weld P1, namely, a combination of straight tensile stress, bending stress and shear stress that act to break the weld P1. The tensile stress and the bending stress result from the movement created by the kicker force and from rocking or pivoting that occurs about the weld itself when the bending at point A occurs. This same bending at point A tends to straighten to pre-bend at point A and causes the blade 90 to try to lengthen between points P1 and P2. This elongation is resisted by the loop B of the blade 90 and introduces a shear force at the weld P1.

Figure 9:
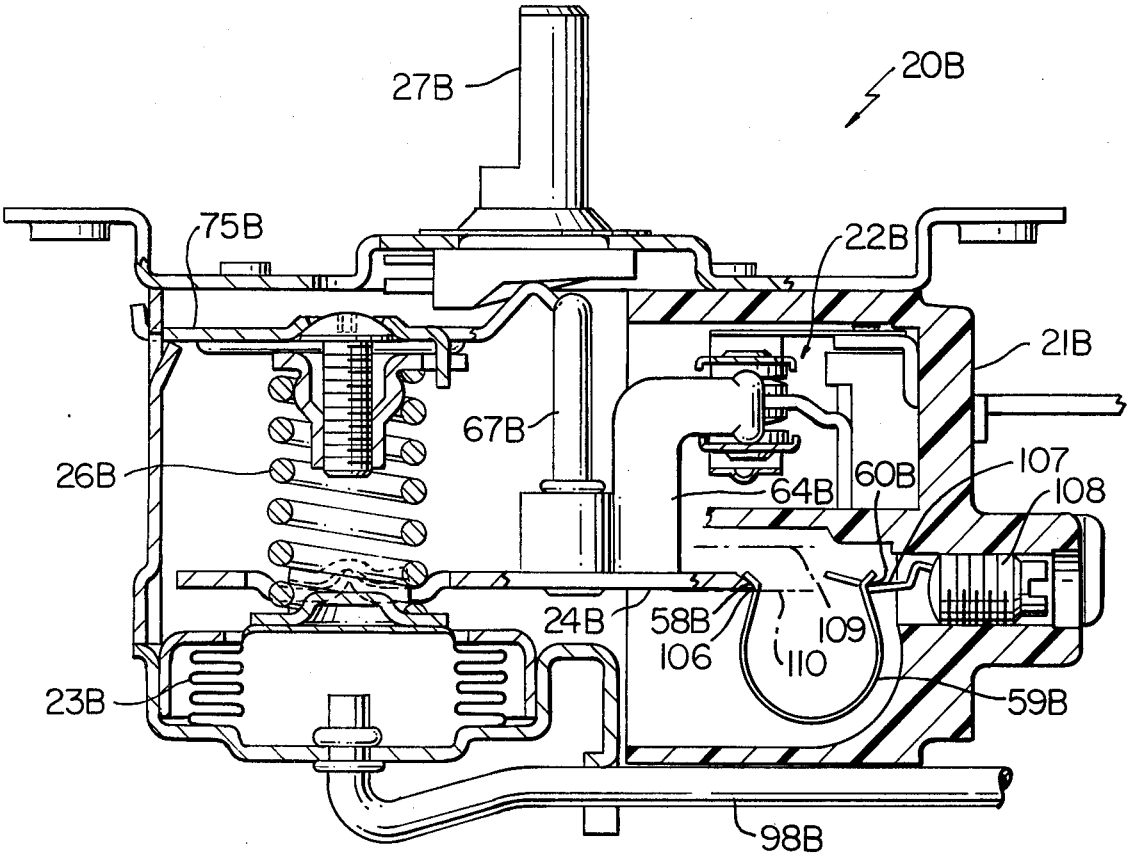
FIG. 9 is a view similar to FIG. 4 and illustrates another embodiment of the improved condition responsive electrical switch construction of this invention.
Figure 12:
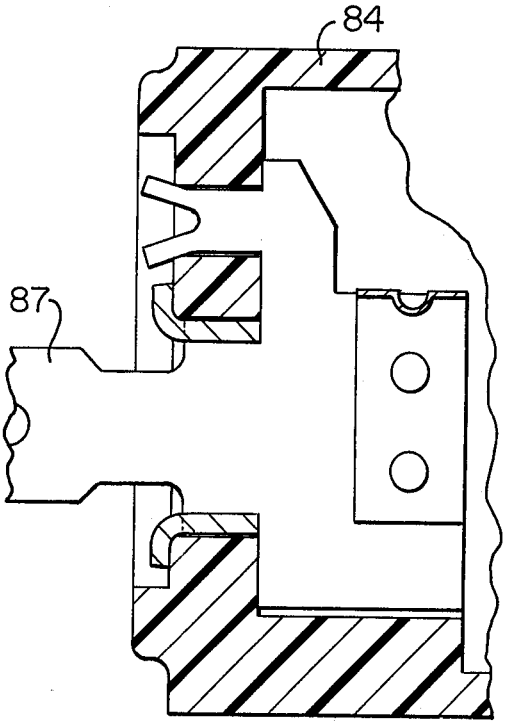
FIG. 12 is a cross-sectional view taken on line 12—12 of FIG. 10.
Figure 13:
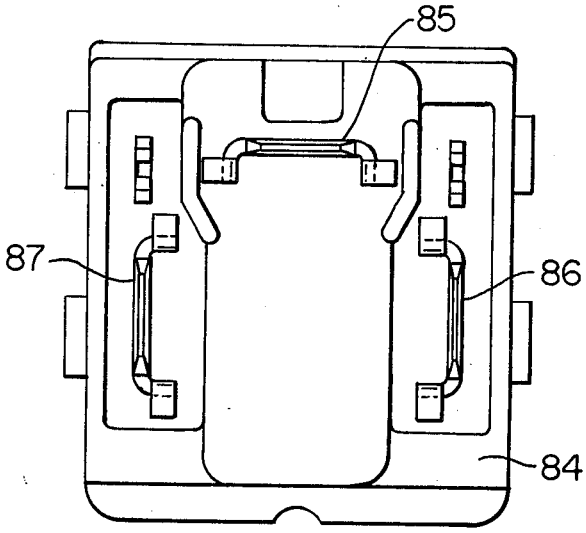
FIG. 13 is a reduced rear view of the structure illustrated in FIG. 11 and is taken in the direction of the arrows 13—13 of FIG. 11.

Another condition responsive electrical switch construction of this invention is generally indicated by reference numeral 20B in FIG. 9 and parts thereof similar to the condition responsive electrical switch construction 20 previously described are indicated by like reference numerals followed by the reference letter "B."

As illustrated in FIG. 9, it can be seen that basically the condition responsive electrical switch construction 20B is the same as the condition responsive electrical switch construction 20 previously described except that the stop 68 and differential adjusting plate and stop 51 have been eliminated, the lever 24B has been shortened and the rolling spring 59B has its notch 59B disposed against a knife edge 106 at the free end of the lever 24B while its other notch 60B is disposed against a lever 107 carried by the frame means 21B and being adjusted by a threaded adjusting member 108 for the same purpose as the adjusting screw 54 previously described. However, the operation of the control device 20B is substantially similar to the control device 20 previously described as the rolling spring 59B will cause the actuator 64B to operate and switch construction 22B in the same manner previously described and for the purpose previously described, the up and down movement of the lever 24B being limited by the same abutting a high pressure stop 109 (FIGS. 10 and 11) of the switch housing 84B or the lower pressure stop 110 (FIGS. 10 and 11) of the switch housing 84B.

Another condition responsive electrical switch construction of this invention is generally indicated by the reference numeral 20C in FIGS. 15–28 and parts thereof similar to the condition responsive electrical switch constructions 20 and 20B previously described are indicated by like reference numerals followed by the reference letter "C".

Figure 15:
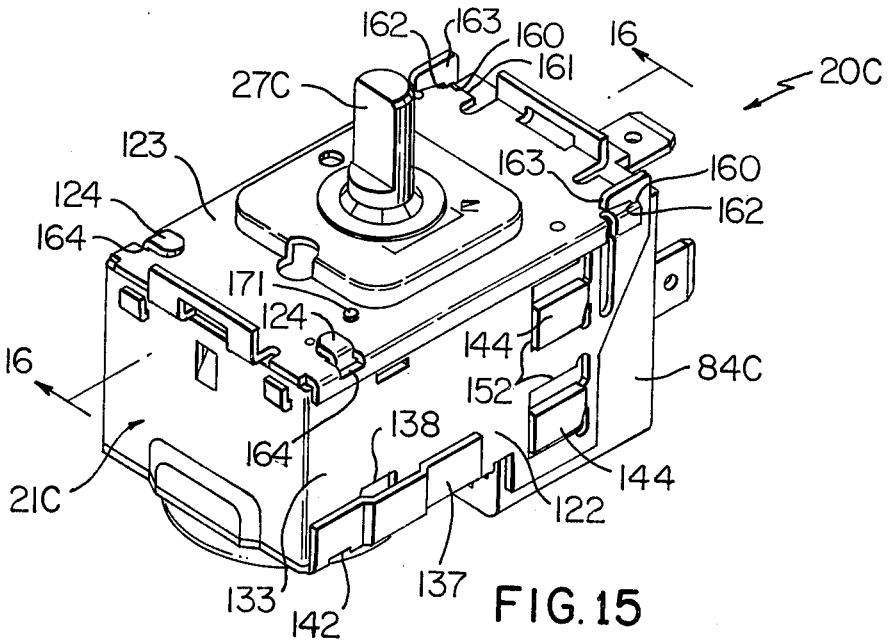
FIG. 15 is a top perspective view of another improved condition responsive electrical switch construction of this invention.
Figure 16:
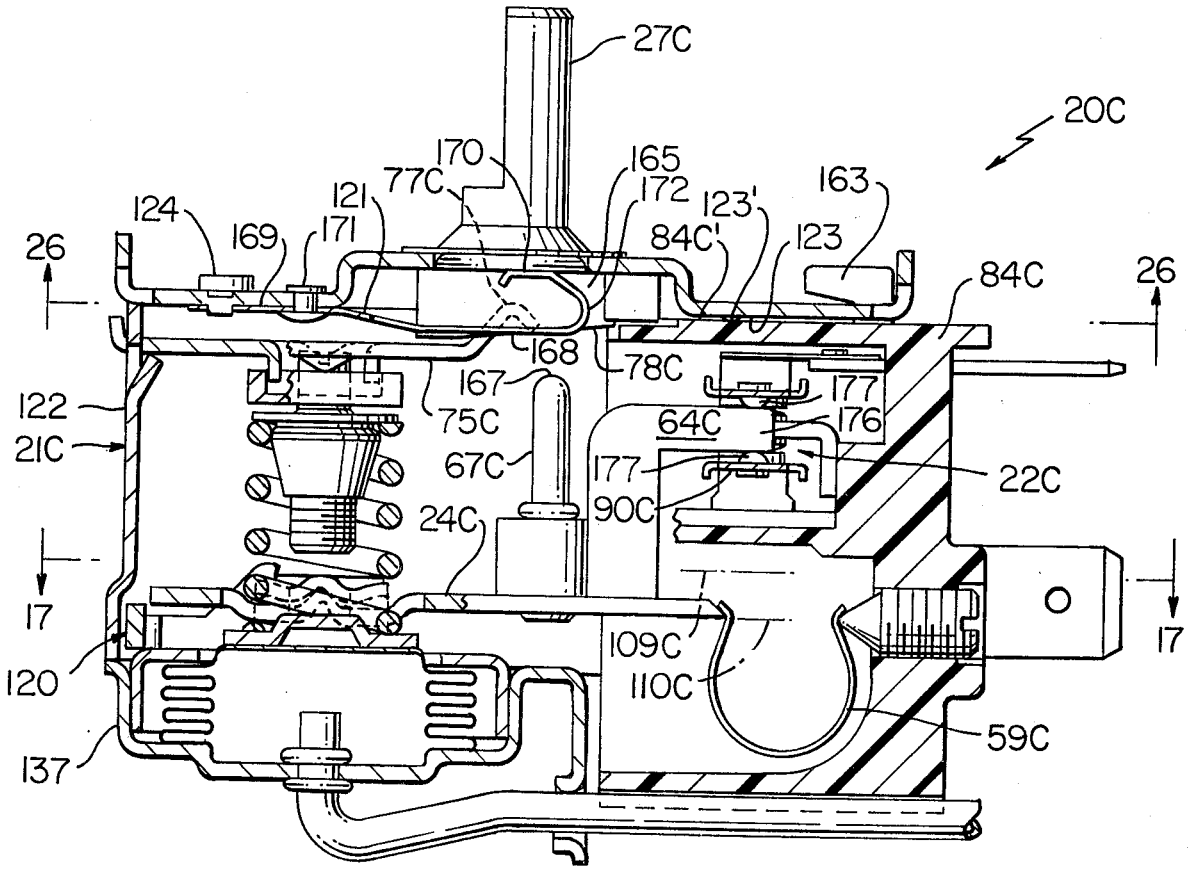
FIG. 16 is an enlarged, cross-sectional view taken on line 16—16 of FIG. 15.

As illustrated in FIGS. 15 and 16, the condition responsive electrical switch construction 20C is basically the same as the condition responsive electrical switch constructions 20 and 20B previously described except that the condition responsive electrical switch construction 20C includes an insert 120 for providing the fulcrum points for the lever 24C in a manner hereinafter described and a spring member 121 for cooperating with the selector means 27C to prevent adverse forces being imposed upon the lever 24C when the selector means 27C is moved to an "off" condition thereof as hereinafter described. The condition responsive electrical switch construction 20C also has the housing means or frame means 21C thereof uniquely formed from the switch housing means 84C, a frame casing 122 and a cover 123 in a manner hereinafter described, the condition responsive electrical switch construction 20C also having additional changes therein as will be apparent from the drawings.

In regards to the insert 120, it has been found that since the casing member 122 utilized for forming the housing means 21C utilizes bent or folded over tabs, such as tabs 124, as a means for fastening the housing assembly 21C together in a manner hereinafter set forth, it is required that the casing member 122 be formed from a ductile metallic material.

For example, it is common practice in the present art of assembling temperature cold controls to utilize bent or folded over tabs as a means of fastening the assembly together. This has proven to be a reliable low cost approach as a fastening means. The typical enclosure for the cold control consists of a frame, cover, power element and switch base. As a matter of convenience, the frame is constructed with the tabs to be folded over as a fastening means for the cover and power element and in some instances the frame construction utilizes a member capable of being staked to secure the switch base. Hence, the preceeding fastening and securement means create the need for a ductile frame member.

However, such frame member is usually constructed with pivot seats for one or more pivoting levers. In most instances, one of the pivoting levers is part of the snap mechanism. As such, friction at the pivot must be minimized to achieve repeatability and a good clean snap action. The type of pivot commonly used to attain the preceeding is a knife-edge on the lever seated in a "vee" seat in the frame.

High temperature differential controls impose high bearing loads on the lever knife-edges and frame "vee" seats. To minimize wear at the pivots, it is common practice to harden the knife edges or use a more costly secondary lever to reduce the bearing load, such as in the aforementioned U.S. Pat. No. 3,096,419. The hardened knife-edges protect the lever in a single lever system but little can be done to protect the "vee" frame seats because the frame must be kept soft or ductile for the aforestated assembly purposes.

It was found that spot hardening the "vee" frame seats is not economically feasible.

Accordingly, it is a feature of this invention to provide a hardened "vee" seat insert 120 that replaces the soft frame 122 "vee" seats. This combination of hardened "vee" seats supporting hardened knife-edges minimizes wear and thus, less callibration change from the same. The hardened "vee" seat insert 120 of this invention, when used in the single lever system of the condition responsive electrical switch construction 20C of this invention, offers a believed to be economical advantage over a dual lever system such as is employed in the aforementioned U.S. Pat. No. 3,096,419.

Figure 22:
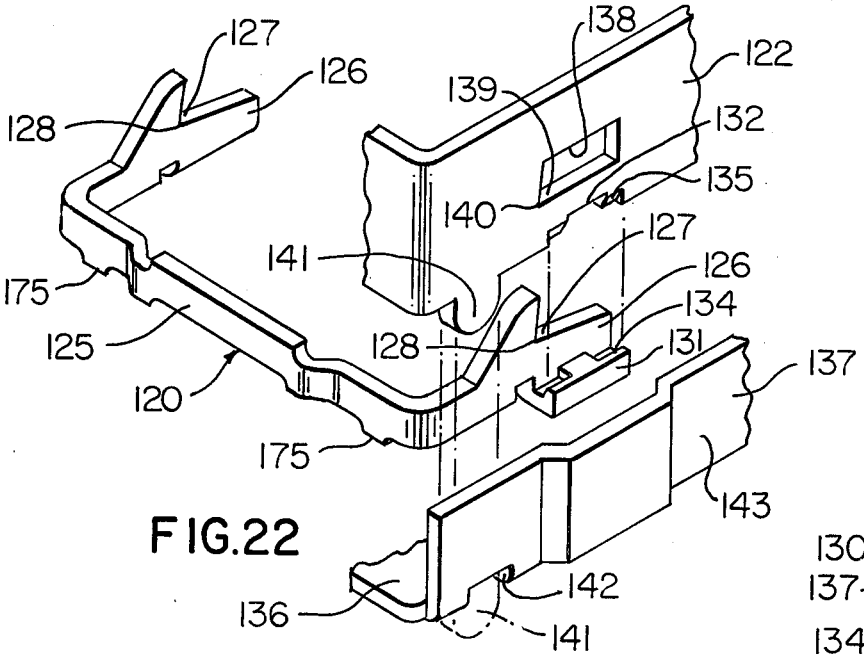
FIG. 22 is a fragmentary, exploded, perspective view of the various parts forming the pivot arrangement of FIGS. 19–21.
Figure 19:
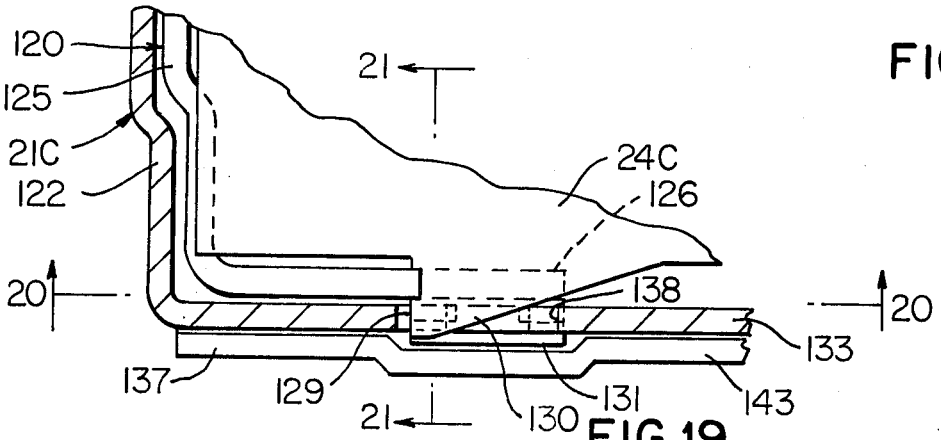
FIG. 19 is an enlarged fragmentary view of a portion of FIG. 17 and illustrates one of the pivot points for the actuator lever.
Figure 20:
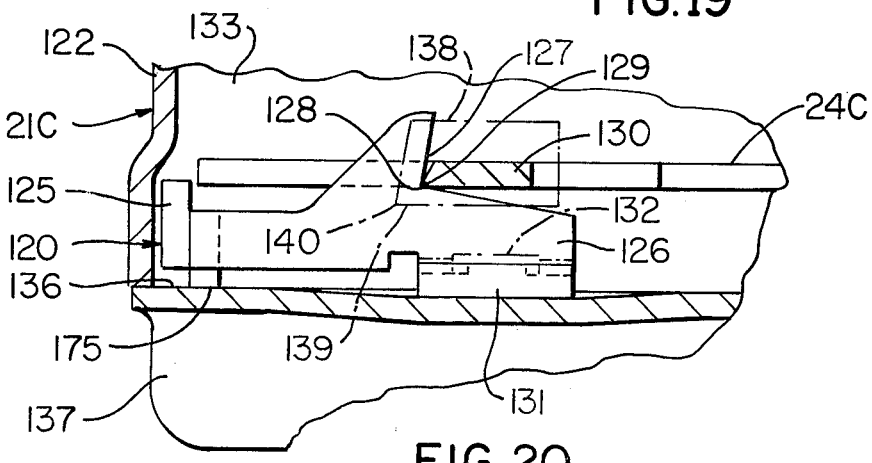
FIG. 20 is a cross-sectional view taken on line 20—20 of FIG. 19.

Accordingly, reference is now made to FIG. 22 wherein it can be seen that the hardened metallic insert 120 comprises a substantially U-shaped member defined by a cross member 125 and a pair of legs 126 extending therefrom each leg 126 having a "vee" surface means 127 for receiving at the elbow 128 thereof one of the hardened knife-edges 129, FIGS. 19 and 20, of an outwardly extending, integral, substantially triangular tab 130 of the lever 24C which is normally urged to the left in FIG. 16 into the elbows 128 of the insert 120 by the compressive force of the rolling spring 59C as illustrated in FIG. 16.

Figure 21:
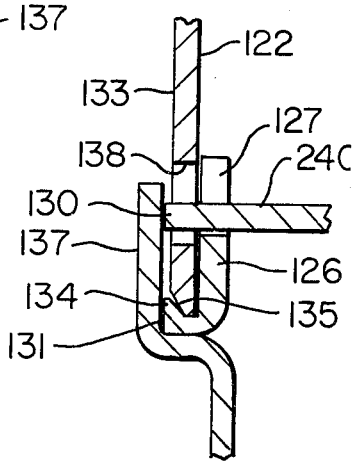
FIG. 21 is a cross-sectional view taken on line 21—21 of FIG. 19.

Each leg 126 of the insert 120 has an outwardly extending integral detent-like tab 131 adapted to be received respectively in a cooperating cutout or recess 132 formed in a respective side 133 of the frame casing 122 as illustrated in FIGS. 20 and 21 with portions 134 of the detents 131 of the insert 120 actually hooking around the peripheral edges 135 of the respective sides 133 of the frame casing 122 to prevent the legs 126 from being pulled inwardly relative to the sides 133 after the insert 120 has been fully seated in the cutouts 132 as illustrated.

In addition, the cross member 125 of the insert 120 has a plurality of depending abutments 175 for engaging against the peripheral end surface 136 of another housing casing 137 of the housing means 21C that carries the condition responsive device 23C and is assembled to the construction 20C by the casing 137 being secured to the casing 122 through the aforementioned folded tab means similar to the tab means 124 previously described. For example, see the tabs 141 of FIG. 22.

The opposed sides 133 of the frame casing 122 have openings 138 passing therethrough which would normally provide a "vee" surface means 139 for supporting the knife-edges 129 of the tongues 130 of the lever 24C as the tongues 130 of the lever 24C readily project outwardly through the openings 138 so as to cause the knife-edges 129 to bear against the elbows of the "vee" surfaces 139.

In fact, when the electrical switch construction 20C is being initially assembled, the tongues 130 of the lever 24C are normally disposed against the elbows 140 of the surfaces 139 of the openings 138 of the casing 122 before the insert 120 is inserted into the end of the casing 122 into the position illustrated whereby the "vee" surfaces 127 of the inserted insert 120 engage the knife-edges 129 of the tongues 130 of the lever 24C and move the same upwardly and to the right in FIG. 20 away from the surfaces 139 of the openings 138 as illustrated in FIG. 20 so that when the insert 120 is in its fully inserted and located position, the surfaces 139 of the openings 138 of the casing 122 will no longer engage the tongues 130 of the lever 24C.

After the insert 120 has been inserted in place as illustrated in FIGS. 19–21, the bellows casing or cup 137 is secured to the frame casing 122 and it can be seen that the peripheral surface 136 thereof is not only bowed by the detents 131 of the legs 126 of the insert 130 so as to continuously place a biasing force on the detents 131 to hold the insert 120 firmly in the recesses 132 of the casing 122, but also the peripheral surface 136 of the bellows cup 137 engages against the extensions 175 of the cross member 125 of the insert 120 to prevent the same from pivoting in a counterclockwise direction in FIG. 20 through the forces caused by the compression force of the rolling spring 59C tending to pivot the lever 24C.

The insert 120 must be located accurately in the assembly of the construction 20C for good snap action of the lever 24C and must retain its assembled position to prevent a callibration change. The toggle spring loading on lever 24C induces a movement on the seat insert 120 which tends to rotate it from its desired working position. Supplemental resistance to such movement is provided by the outboard supports 175 on the insert 120 that rests on the face 136 of the casing 137 and the interlock provided by the notches 132 and coined detents 131 on the insert 120 that prevent the insert 120 from working inward when gripped by the securement means.

Thus, it can be seen that this invention provides an economical means to minimize callibration change due to wear in a soft frame casing and yet retain the assembly advantages of the ductile frame member through the use of the hardened metallic insert 120 of this invention in the manner previously described.

Accordingly, the insert 120 of this invention does not require any auxiliary fastening means therefor as the same is merely inserted in place with the legs thereof 126 being disposed inboard of the sides 133 of the casing 122 and the insert 120 is held in place by the casing member 137 being secured to the casing member 122, such as by the casing member 122 having tabs 141 projecting through slots 142, FIG. 22, of the casing 137 to be thereafter bent over to hold the casing means 122 and 137 in their clamped together position of FIGS. 20 and 21 and thereby hold the insert 120 firmly in place so that the "vee" surfaces 127 of the insert 120 provide the fulcrum points for the tongues 130 of the lever 24C. Thus, the lever 24C can act in the manner previously described to control the electrical switch 22C in the manner previously described.

While the inserts 120 of this invention can be formed by any suitable method and from any suitable metallic material, each insert 120 could be formed into the configuration illustrated before such insert 120 is hardened and thereafter be subjected to a conventional hardening treatment.

Figure 17:
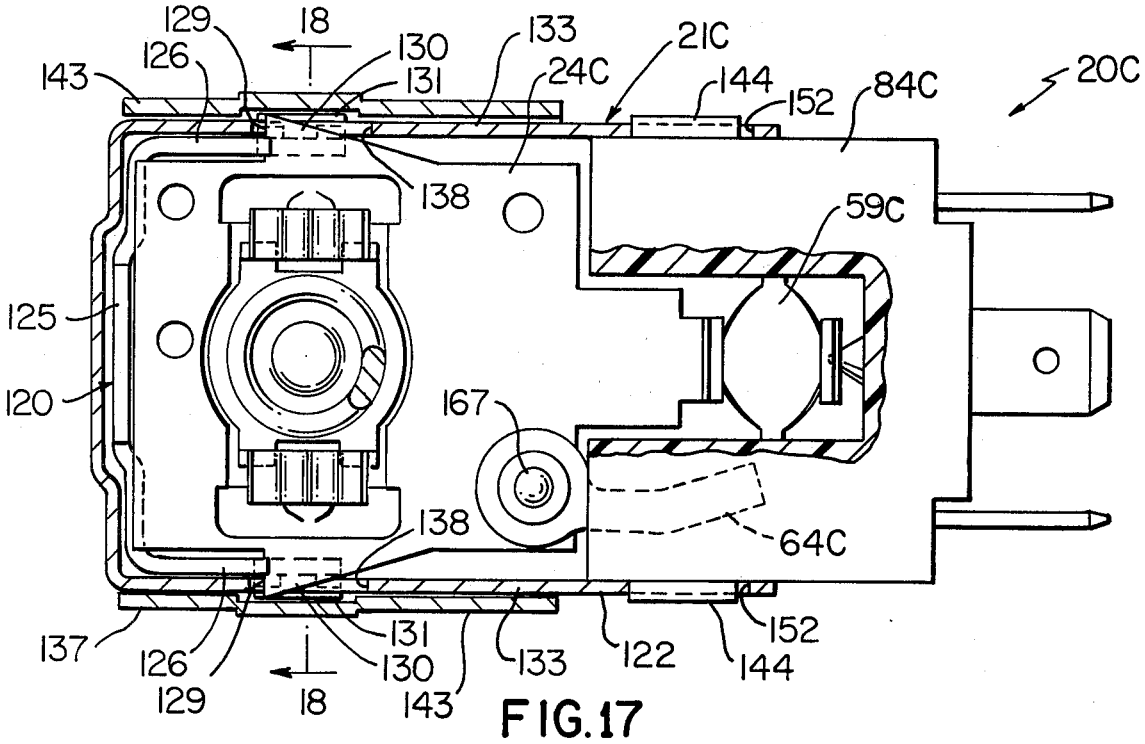
FIG. 17 is a cross-sectional view taken on line 17—17 of FIG. 16.
Figure 18:
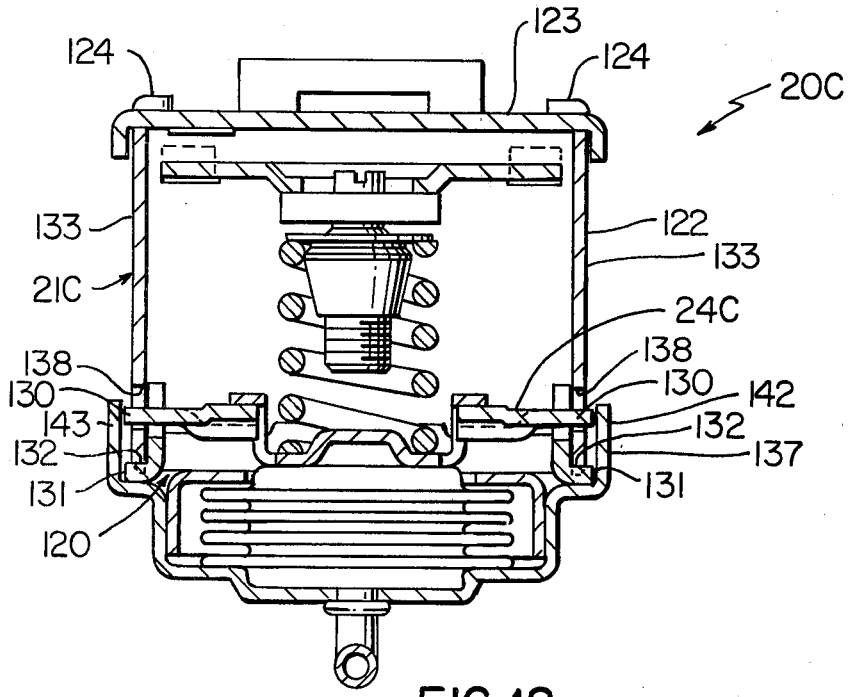
FIG. 18 is a cross-sectional view taken on line 18—18 of FIG. 17.

In order to protect the projecting tongues 130 of the lever 24C at the openings 138 of the casing 122, the lower casing 137 can have side parts 143 which extend upwardly in telescoping relation outboard of the sides 133 of the casing 122 a sufficient distance to cover the tongues 130 in the manner illustrated in FIGS. 17, 18 and 21. However, other means can be utilized, if desired, to protect the tongues 130.

Since the position of the electrical switch 22C and stops 109C and 110C of the switch housing means 84C must be accurately positioned relative to the pivot points 128 for the lever 24C for the control device 20C to be accurate, positive positioning of the housing means 84C and casing 122 relative to each other must be maintained.

Accordingly, it is another feature of this invention to provide improved means for locating and securing housing 84C relative to the casing 122.

In particular, the switch housing 84C is provided with two pairs of outwardly directed opposed ears 144 that extend outwardly from the opposed sides of the substantially rectangularly shaped housing member 84C, the ears 144 being integral with the housing 84C.

Each ear 144 is similarly formed and each has opposed side edges 146 and 147 interconnected together by a pair of opposed end edges 148 and 149, the end edges 148 and 149 being substantially flat and parallel to each other and disposed at right angles to the side edge 146 which is substantially flat and perpendicular to the end edges 148 and 149 as illustrated. The side edge 147 has a first part 150 thereof that is substantially flat and parallel to the side edge 146 and a second part 151 thereof which is disposed at an angle relative to the part 150 for a purpose hereinafter described.

The opposed sides 133 of the casing 122 have two pairs of opposed slot means 152 formed therethrough and each being defined by a pair of opposed side surface means 153 and 154 interconnected together by a pair of opposed end surface means 155 and 156. The end surface means 156 and 155 are substantially flat and parallel to each other and are disposed substantially at right angles to the substantially flat side surface means 153 as illustrated. The end surface 154 of each slot 152 comprises a biasing section of the frame 122 and has a rounded extension 157 that extends into the slot 152 and is carried by a narrow band 158 of the frame 122 so as to render the same substantially flexible as illustrated and for a purpose hereinafter described.

The upper pair of slots 152 have the end surfaces 156 thereof each provided with a raised flat section 159 for a purpose hereinafter described.

Figure 23:
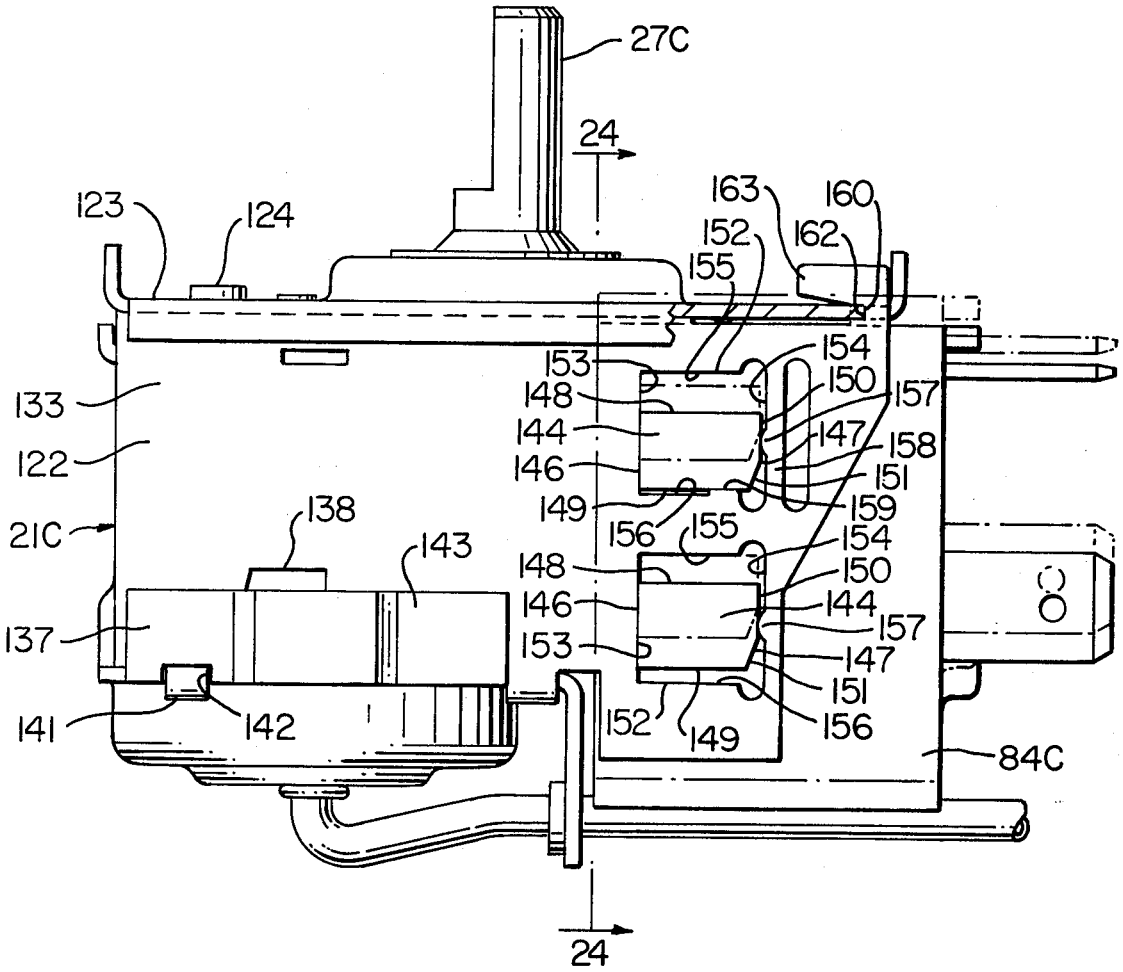
FIG. 23 is an enlarged side view of the condition responsive electrical switch construction of FIG. 15.
Figure 25:
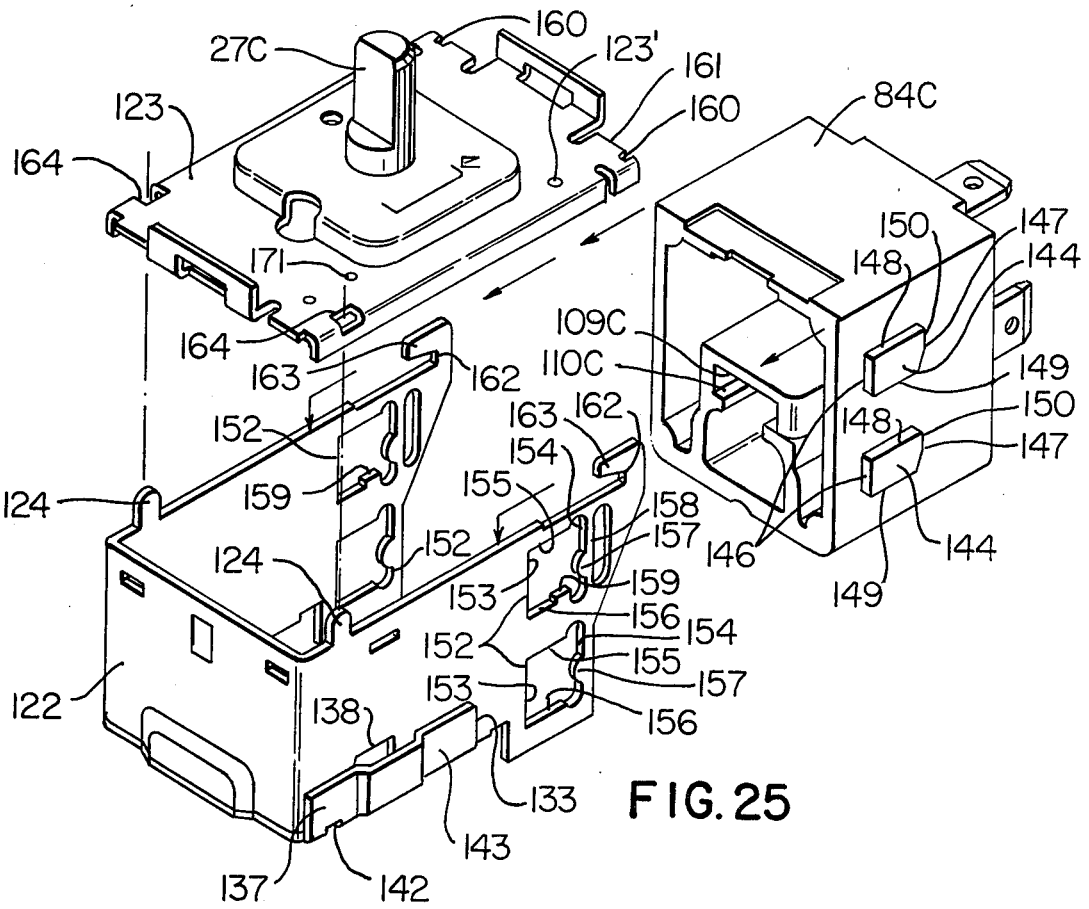
FIG. 25 is an exploded perspective view of the housing parts of the condition responsive switch construction of FIG. 15.
Figure 24:
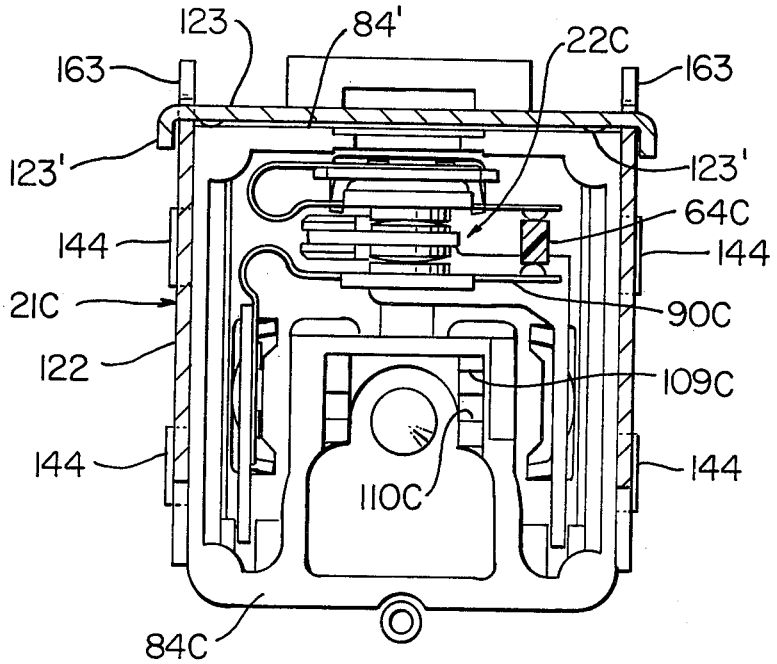
FIG. 24 is a cross-sectional view taken on line 24—24 of FIG. 23.
Figure 26:
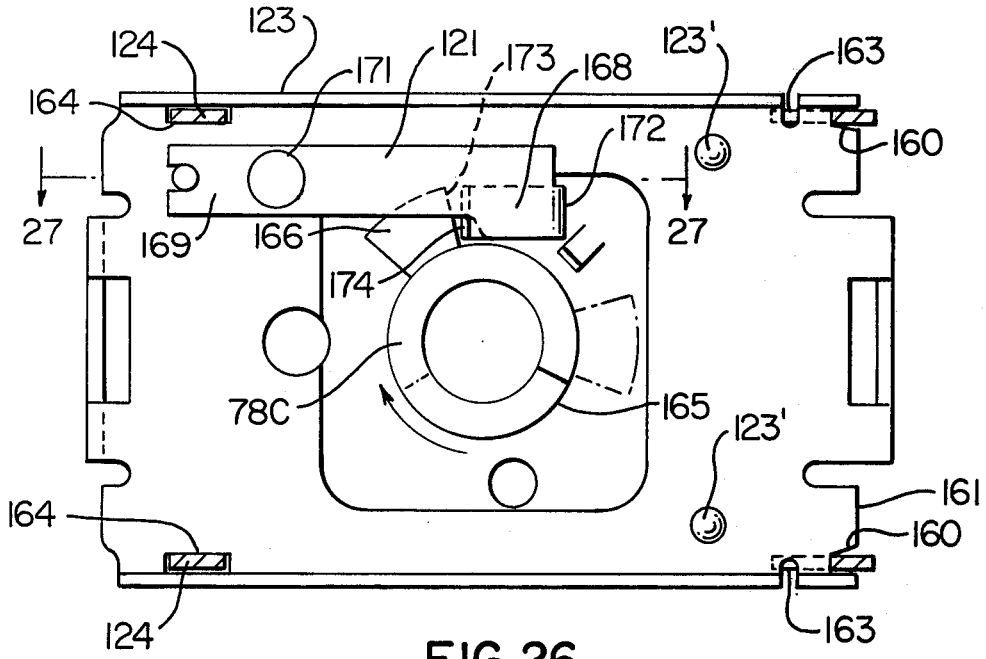
FIG. 26 is a cross-sectional view taken on line 26—26 of FIG. 16.

When it is desired to assemble the housing means 21C of the switch construction 20C of this invention, the switch housing member 84C, together with its switch structure 22C which is not shown in FIG. 25, is inserted downwardly in between the sides 133 of the casing 122 as illustrated by dash-dotted lines in FIG. 23 until the ears 144 snap respectively into the upper portions of the slots 152 as illustrated by dash-dotted lines in FIG. 23 because the sides 133 of the frame 122 are slightly sprung apart to premit such initial insertion of the housing 84C therebetween.

When the ears 144 of the housing 84C are thus initially snapped into the upper portions of the slots 152 of the casing 122 as illustrated by the dash-dotted lines in FIG. 23, it can be seen that the rounded extensions 157 of the biasing sections 158 of the slots 152 are disposed against the angular parts 151 of the end surfaces 147 of the ears 144 so that as the casing 84C is further forced downwardly from the dash-dotted position in FIG. 23 to the full line position illustrated in FIG. 23, the biasing sections 158 are cammed outwardly by the angular parts 151 until the rounded extensions 157 engage against the straight parallel parts 150 at which time the force of the biasing sections 158 maintains the flat side edges 146 of the ears 144 firmly against the flat side edges 153 of the slots 152 as illustrated. Further, when the housing 84C has been pushed downwardly to the full-line position illustrated in FIG. 23, the end edges 149 of the upper pair of ears 144 bottom out against the flat parts 159 of the end surfaces 156 of the upper pair of slots 152 to positively locate the downward position of the housing 84C in the casing 122 while the telescoping direction of the housing 84C transverse thereto is positively located by the flat surfaces 146 of the ears 144 being held against the flat surfaces 153 of the slots 152 by the biasing sections 158. The biasing sections 158 also hold by friction the end surfaces 149 of the upper pair of ears 144 against the end surface parts 159 of the upper pair of slots 152.

At this time, the housing 84C is firmly and accurately positioned relative to the casing 122 and no further adjustment is required therebetween.

However, in order to hold the housing 84C in the final assembled position of FIG. 23, the cover member 123 is utilized and notches 160 at the edge 161 of the cover member 123 are pivoted into notches 162 of ear-like extensions 163 of the frame 122. Thereafter the cover member 123 is then pivoted downwardly so that the tabs 124 of the frame 122 can project through the cooperating slots 164 in the cover member 123 and thereafter be folded over in the manner illustrated in FIG. 15 to fasten the cover member 123 in place.

As the cover member 123 is being pivoted into place, the lower surface 123' thereof as illustrated in FIG. 23 biases against the upper end surface 84C' of the housing 84C to maintain the end surfaces 149 of the upper pair of ears 144 against the flat portions 159 of the upper pair of slots 152 whereby it can be seen that the cover member 123 is, in effect, secured to both of the housing parts 84C and 122.

In this manner, the cover member 123 will now hold the housing member 84C in its assembled relation with the casing 122, the cover member 123 also being held in its assembled relation with the casing 122 and housing 84C by the bent over tabs 124.

Therefore, it can be seen that the ears 144 of the housing means 84C and the slots 152 of the casing 122 cooperate in a unique manner to permit positive and accurate alignment of the housing means 84C relative to the frame 122 and, thus, positive and accurate alignment of the electrical switch means 22C relative to the lever 24C to operate in the manner previously described for the control device 20.

Figure 27:
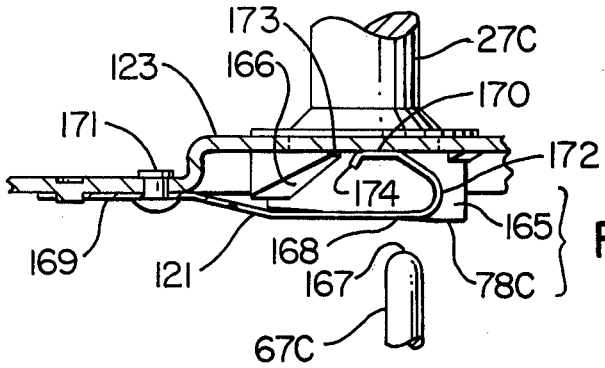
FIG. 27 is a fragmentary, cross-sectional view taken on line 27—27 of FIG. 26.
Figure 28:
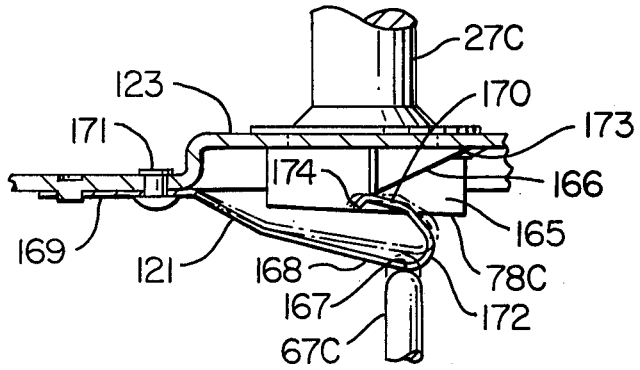
FIG. 28 is a view similar to FIG. 27 and illustrates the selector means set in the "off" position thereof.

In addition, the rotatable cam 165 has a cam surface 166, FIGS. 27 and 28, which is utilized for operatively acting on the end 167 of the abutment means 67C that is carried by the lever 24C to positively hold the lever 24C in its downward position against the lower stop 110C of the switch housing 84C when the selector shaft 27C is turned to its "off" position.

In control devices similar to the control device 20C of this invention, the cam surface 166 was normally constructed to directly engage against the end 167 of the abutment 67C so that when the selector shaft 27C was turned to the "off" position thereof, positive engagement of the lever 24C was provided against the stop 110C.

However, it was found according to the teachings of this invention, that if there was any overtravel of the selector means 27C in the "off" direction thereof after the lever 24C against the stop 110C, such as by the abutment means 67C being too long, such further downward action on the abutment means 67C tended to pivot and pull the lever 24C out of its knife-edge engagement with the "vee" surface means 127 so that misalignment of the lever 24C might result.

Accordingly, it is a feature of this invention to eliminate the adverse overtravel between the selector means 27C and the abutment means 67C and this is accomplished by providing a biasing means 168 between the cam surface 166 of the selector means 27C and end 167 of the abutment means 67C.

In particular, the biasing means 168 comprises a leaf-like spring member having opposed ends 169 and 170 with the end 169 being fastened to the cover member 123 by a suitable rivet 171 or the like and the other end 170 of the biasing member 168 being looped back upon itself to define a loop 172 that is adapted to be disposed fully between the cam surface 166 and the end 167 of the abutment means 67C to transmit motion between the cam surface 166 to the abutment 67C and thereby cause the lever 24C to engage against the lower stop 110C and thereafter take up any overtravel therebetween in the manner illustrated by dash-dotted lines in FIG. 28 as the loop 172 will partially collapse to take up such over-travel movement.

In order to permit the cam surface 166 to wedge under the end 170 of the biasing member 168 when the selector means 27C nears the "off" position thereof, the outer end 174 of the end 170 is further turned inwardly to permit the leading edge 173 of the cam surface 166 to wedge under the same as the end 170 of the biasing member 168 normally bears against the under surface 173 of the cover member 123 as illustrated.

Therefore, it can be seen that the biasing member 168 can be assembled to the control device 20C in a simple and effective manner to operate in a manner now to be described.

When it is desired to turn the selector means 27C of the control device 20C to the "off" position thereof, the operator rotates the selector shaft 27C in the proper direction so that the "off" cam surface 166 wedges under the edge 170 of the biasing member 168 and moves the biasing member 168 downwardly to engage against the end 167 of the abutment 67C and thereby move the abutment 67C downwardly until the lever 24C bottoms out against the bottom stop 110C of the switch housing and thereby hold the electrical switch 22C in the "off" position thereof. However, should there be further downward movement of the cam surface 166 by the selector shaft 27C being further rotated in an "off" direction such as caused by a mistolerance of the length of the abutment 67C, such additional downward travel of the cam surface 166 tending to move the biasing means 168 downwardly is taken up by the compression or flattening of the loop 172 of the biasing means 168 so that further damaging downward force on the abutment 67C will not cause the lever 24C to tend to move out of its pivot edges 127 as previously described. In fact, the loop 172 might take a permanent compressed set after initially taking up the overtravel for a particular control 20C.

Other changes are provided in the construction 20C over the structure of the constructions 20 and 20B, such as by having the kicker 64C provided with a flat section 176 to engage against rounded abutments 174 of the switch blades 89C and 90C rather than having the kicker 64C provided with the rounded engaging parts as in the construction 20. Also, it can be seen that the switch blade 90C has its lower end positioned differently than in the control 20, but the operation of the blade 90C is substantially the same as the blade 90.

Therefore, it can be seen that this invention not only provides an improved condition responsive electrical switch construction but also an improved range spring and lever arrangement for such a condition responsive electrical switch construction or other structure as desired.

Also, it can be seen that this invention provides an improved electrical switch and method of making the same whether or not such electrical switch is utilized in the condition responsive electrical switch construction of this invention or for other purposes as desired.

In addition, it can be seen that this invention provides improved parts for such an electrical switch construction or the like.

While the forms and methods of this invention as now preferred have been illustrated and described as required by the Patent Statute, it is to be understood that other forms and method steps can be utilized and still fall within the scope of the appended claims.

What is claimed is:

1. In an electrical switch construction having frame means carrying fixed contact means and movable contact means to be moved relative to said fixed contact means by a knicker-type actuator member, said fixed contact means comprising a single contact member and said movable contact means comprising a pair of movable contact members disposed on opposite sides of said fixed contact member and each being biased in a direction to tend to place the same in contact with said fixed contact member, said actuator member being disposed between said pair of movable contact members and being movable in opposite directions to engage and move the respective movable contact member out of contact with said fixed contact member, the improvement wherein each movable contact member comprises a conductive blade having two legs joined together by a loop at adjacent ends of said legs, one of said legs of each blade being substantially straight and having said loop offset therein at said end thereof to cause that leg to tend to elongate between said fixed contact member and the outside edge of said loop should a weld exist between that leg and said fixed contact member when said actuator member is attempting to move that conductive blade out of contact with said fixed contact member, each said conductive blade having said one leg thereof engageable with said actuator member and adapted to make contact with said fixed contact member intermediate said offset loop thereof and where said actuator member is engageable with said one leg.

2. An electrical switch construction as set forth in claim 1 wherein one of said movable contact members has the other leg thereof disposed substantially parallel to said one leg thereof.

3. An electrical switch construction as set forth in claim 1 wherein one of said movable contact members has the other leg thereof disposed substantially transverse to said one leg thereof.

4. An electrical switch construction as set forth in claim 1 wherein any position of said actuator member between said pair of movable contact members always causes only one or the other of said pair of movable contact members to be in contact with said fixed contact member.

5. An electrical switch construction as set forth in claim 1 wherein each said movable contact member has said one leg thereof disposed spaced from and substantially parallel to said one leg of the other movable contact member.

6. An electrical switch construction as set forth in claim 5 wherein said loops of said movable contact members are offset toward each other.

7. An electrical switch construction as set forth in claim 6 wherein said one legs of said movable contact members are disposed transverse to said fixed contact member.

8. An electrical switch construction as set forth in claim 7 wherein said one legs of said movable contact members are disposed in aligned relation on opposite sides of said fixed contact member.

9. An electrical switch construction as set forth in claim 8 wherein said frame has two terminal means respectively interconnected to said other legs of said movable contact members.

10. An electrical switch construction as set forth in claim 1 wherein one of said actuator members and said movable contact members has rounded abutment means thereon for respectively engaging the other of said actuator members and said movable contact members.

11. In a method of making an electrical switch construction having frame means carrying fixed contact means and movable contact means to be moved relative to said fixed contact means by a kicker-type actuator member, said fixed contact means comprising a single contact member and said movable contact means comprising a pair of movable contact members disposed on opposite sides of said fixed contact member and each being biased in a direction to tend to place the same in contact with said fixed contact member, said actuator member being disposed between said pair of movable contact members and being movable in opposite directions to engage and move the respective movable contact member out of contact with said fixed contact member, the improvement comprising the steps of forming each movable contact member to comprise a conductive blade having two legs joined together by a loop at adjacent ends of said legs with one of said legs being substantially straight and having said loop offset therein at said end thereof to cause that leg to tend to elongate between said fixed contact member and the outside edge of said loop should a weld exist between that leg ans said fixed contact member when said actuator member is attempting to move that conductive blade out of contact with said fixed contact member, and forming each said conductive blade to have said one leg thereof engageable with said actuator member and adapted to make contact with said fixed contact member intermediate said offset loop thereof and where said actuator member is engageable with said one leg.

12. A method of making an electrical switch construction as set forth in claim 11 and including the step of forming one of said movable contact members to have the other leg thereof disposed substantially parallel to said one leg thereof.

13. A method of making an electrical switch construction as set forth in claim 12 and including the step of forming one of said movable contact members to have the other leg thereof disposed substantially transverse to said one leg thereof.

14. A method of making an electrical switch construction as set forth in claim 11 and including the step of forming said actuator member so that any position of said actuator member between said pair of movable contact members always causes only one or the other of said pair of movable contact members to be in contact with said fixed contact member.

15. A method of making an electrical switch construction as set forth in claim 11 and including the step of forming each movable contact member to have said one leg thereof disposed spaced from and substantially parallel to said one leg of the other movable contact member.

16. A method of making an electrical switch construction as set forth in claim 15 and including the step of forming said loops of said movable contact members to be offset toward each other.

17. A method of making an electrical switch construction as set forth in claim 16 and including the step of disposing said one legs of said movable contact members so as to be transverse to said fixed contact member.

18. A method of making an electrical switch construction as set forth in claim 17 and including the step of disposing said one legs of said movable contact members in aligned relation on opposite sides of said fixed contact member.

19. A method of making an electrical switch construction as set forth in claim 18 and including the step of interconnecting two terminal means of said frame respectively to said other legs of said movable contact members.

20. A method of making an electrical switch construction as set forth in claim 11 and including the step of forming said actuator member with opposed rounded abutments thereon for respectively engaging said movable contact members.

* * * * *